US007523726B2

(12) United States Patent
Nakashima et al.

(10) Patent No.: US 7,523,726 B2
(45) Date of Patent: Apr. 28, 2009

(54) AIR-COOLED V-SHAPED ENGINE

(75) Inventors: Eishin Nakashima, Osaka (JP); Kiyonobu Iida, Osaka (JP); Hiroyuki Tsuda, Osaka (JP); Akiyoshi Morikawa, Osaka (JP); Noriaki Kobayashi, Osaka (JP); Masaharu Ohno, Osaka (JP); Hiroyuki Kawasoe, Osaka (JP); Yuki Ozaki, Osaka (JP); Takahiro Tokunaga, Osaka (JP); Takayuki Nakamae, Osaka (JP); Mineo Takasaki, Osaka (JP)

(73) Assignee: Kubota Corporation, Osaka (JP)

( * ) Notice: Subject to any disclaimer, the term of this patent is extended or adjusted under 35 U.S.C. 154(b) by 41 days.

(21) Appl. No.: 11/858,348

(22) Filed: Sep. 20, 2007

(65) Prior Publication Data

US 2008/0127914 A1 Jun. 5, 2008

(30) Foreign Application Priority Data

Dec. 4, 2006 (JP) ..... 2006-326485
Mar. 28, 2007 (JP) ..... 2007-083498

(51) Int. Cl.
*F01P 1/02* (2006.01)
*F01P 7/04* (2006.01)
*F02B 75/22* (2006.01)

(52) U.S. Cl. ..... 123/41.7; 123/41.65; 123/54.4

(58) Field of Classification Search ..... 123/41.56, 123/41.63, 41.64, 41.65, 41.67, 41.7, 54.4, 123/54.5, 54.6, 54.7, 54.8
See application file for complete search history.

(56) References Cited

U.S. PATENT DOCUMENTS 2,585,083 A * 2/1952 Bouvy ..... 123/41.65
4,204,486 A * 5/1980 Nakagawa et al. ..... 123/41.6
6,904,883 B2 * 6/2005 Snyder et al. ..... 123/90.31

FOREIGN PATENT DOCUMENTS

JP 2006-090255 A 4/2006

* cited by examiner

*Primary Examiner*—Noah Kamen
(74) *Attorney, Agent, or Firm*—Panitch Schwarze Belisario & Nadel LLP

(57) ABSTRACT

An air-cooled V-shaped engine comprises a throttle body (10) and a flow-dividing plate (9) arranged ahead of a central cooling-air passage (8). The flow-dividing plate (9) is provided in a fan case (5) at a position forwardly of the throttle body (10) and has a bottom-plate portion (14) disposed at a position lower than the throttle body (10). The flow-dividing plate (9) divides the cooling air generated by an air-blowing fan (7) toward left and right sides of the central cooling-air passage (8). In this air-cooled V-shaped engine, the fan case (5) has a ceiling wall a central portion (11) of which is positioned just above the bottom-plate portion (14) of the flow-dividing plate (9). The central portion (11) of the ceiling wall of the flow-dividing plate (9) is provided at a position higher than the throttle body (10) as well as the central side portions (12), (12) of the ceiling wall, led out of the central portion (11) in a left and right directions.

29 Claims, 14 Drawing Sheets

24
26a
26

26a
24
26
D
D
64

24
26a
26
64
64
64
64

64
26

38
69
43

38
43
69
C
C 38
43
69

AIR-COOLED V-SHAPED ENGINE

BACKGROUND OF THE INVENTION

1. Technical Field

The present invention concerns an air-cooled V-shaped engine and more particularly relates to an air-cooled V-shaped engine able to enhance a cooling efficiency of a cylinder and a cylinder head and alleviate the labor burden taken for cleaning the engine.

2. Background Art

An example of the conventional air-cooled V-shaped engines comprises a crank case from which cylinders project slantwise upwards in a left and right direction, when seen from the front in a direction parallel to a center axis of a crank shaft, and cylinder heads attached to the respective cylinders to form a main body of the engine. A fan case is attached to a front portion of the engine's main body and houses an air-blowing fan and a central cooling-air passage is formed between the left and right cylinders and between the cylinder heads so as to feed the cooling air generated by the air-blowing fan to the central cooling-air passage.

A throttle body and a flow-dividing plate are arranged in front of the central air-cooling passage and the flow-dividing plate is provided in the fan case at a position forwardly of the throttle body and has a bottom-plate portion disposed at a position lower than the throttle body, so that the flow-dividing plate divides the cooling air produced by the air-blowing fan toward the left and right sides of the central cooling-air passage.

The air-cooled V-shaped engine of this type has an advantage that the cooling air produced by the air-blowing fan is divided to near the left and right cylinders as well as the cylinder heads so as to cool them uniformly.

However, in the conventional air-cooled V-shaped engine, a ceiling wall of the fan case has a mid portion arranged just below the throttle body, which mid portion forms a bottom-plate portion of the flow-dividing plate, so that an upper mid portion of the fan case is largely concaved downwardly with the result of causing problems.

The above-mentioned conventional technique has the following problems.

<Problem> The cylinder and the cylinder head are cooled with a low efficiency.

The ceiling wall of the fan case has a mid portion arranged just below the throttle body, which mid portion forms a bottom-plate portion of the flow-dividing plate, so that an upper mid portion of the fan case is largely concaved donwardly. This narrows an outlet for blowing air from the upper portion of the fan case to the central cooling-air passage, thereby enlarging the air-passage resistance of the air-blowing outlet to result in reducing the amount of the air blown to the central cooling-air passage and therefore decreasing the cooling efficiency of the cylinders and the cylinder heads.

<Problem> It takes lots of labor to clean the engine.

Due to the narrow air-blowing outlet from the upper portion of the fan case to the central cooling-air passage, cut pieces of weeds and straws, dust and the like foreign matters (hereafter referred to as only 'foreign matters') easily clog the air-blowing outlet to increase the number of cleaning operations for the engine. This puts a large burden for cleaning the engine.

SUMMARY OF THE INVENTION

The present invention has an object to provide an air-cooled V-shaped engine capable of solving the above-mentioned problems and more specifically an air-cooled V-shaped engine able to enhance the cooling efficiency of the cylinders and the cylinder heads and alleviate the labor burden for cleaning the engine.

The inventive featuring matter of the invention set forth in claim 1 is as follows.

As exemplified in FIG. 1, when seen from the front in a direction parallel to a crank-shaft center axis 1, cylinders 3 are projecting from a crank case 2 slantwise upwards in a left and right direction, respectively. The respective cylinders 3 have projecting ends to which cylinder heads 4 are attached to form an engine main body. A fan case 5 is attached to a front portion of this engine main body and houses an air-blowing fan 7. A central cooling-air passage 8 is formed between the left and right cylinders 3, 3 and between the cylinder heads 4, 4 and is fed with cooling air produced by the air-blowing fan 7.

As exemplified in FIG. 2, a throttle body 10 and a flow-dividing plate 9 are arranged ahead the central cooling-air passage 8. The flow-dividing plate 9 is provided in the fan case 5 at a position forwardly of the throttle body 10 and has a bottom-plate portion 14 arranged at a position lower than the throttle body 10. The cooling-air generated by the air-blowing fan 7 is divided by the flow-dividing plate 9 toward the left and right side portions of the central cooling-air passage 8. The air-cooling V-shaped engine is constructed as such.

This air-cooling V-shaped engine is characterized in that the ceiling wall of the fan case 5 has a mid portion 11 positioned just above the bottom-plate of the flow-dividing plate 9 and that the mid portion of the ceiling wall of the flow-dividing plate 9 is provided at a position higher than the throttle body 10 than the central side portions 12, 12 of the ceiling wall, conducted out of the mid portion 11 in the left and right direction.

Effect of the Invention (Invention of Claim 8)

<Effect> It is possible to increase the cooling efficiency of the cylinder and the cylinder head.

As exemplified in FIG. 1, a ceiling wall of the fan case 5 has a mid portion 11 arranged just above the bottom-plate portion 14 of the flow-dividing plate 9. The mid portion 11 of the ceiling wall of this flow-dividing plate 9 is provided at a position higher than the throttle body 10 as well as the mid side portions 12, 12 of the ceiling wall conducted out of this mid portion 11 in the left and right direction. This inhibits the likelihood that the fan case 5 has its upper mid portion largely concaved downwardly, with the result of being able to widely form air-blowing outlets 61, 61 from the upper portion of the fan case 5 to the central cooling-air passage 8 below the mid side portions 12, 12 of the ceiling wall of the fan case 5 and reduce the air-passage resistance of the air-blowing outlets 61, 61. This increases the amount of air to be sent to the central cooling-air passage 8, thereby augmenting the cooling efficiency of the cylinders 3 and the cylinder heads 4.

<Effect> It is possible to alleviate the labor burden taken for cleaning the engine.

As exemplified in FIG. 1, the air-blowing outlets 61, 61 can be formed widely from the upper portion of the fan case 5 to the central cooling-air passage 8. This enables the air-blowing outlets 61, 61 to be hardly clogged by the foreign matters that have entered the fan case 5. This makes it possible to reduce the number of cleaning the engine and therefore alleviate the labor burden for cleaning the engine.

(Invention of Claim 2)

It offers the following effect in addition to that presented by the invention of claim 1.

<Effect> It is possible to inhibit the overheating of the throttle body.

As exemplified in FIG. 2, the flow-dividing plate 9 has its bottom-plate portion 14 led out rearwardly. The thus led-out bottom-plate portion 14 covers the throttle body 10 from therebelow. Further, the left and right side-plate portions 15, 15 are conducted out rearwardly. The thus conducted-out side-plate portions 15, 15 cover the throttle body 10 from both of its left and right sides. Therefore, hot air which has been produced within the fan case 5 just after the engine stopped and tries to approach the throttle body 10 is shielded by the bottom-plate portion 14 of the flow-dividing plate 9 and the left and right side-plate portions 15, 15 to thereby inhibit the entrance of the hot air from below the throttle body 10 and both of the left and right sides thereof. This can inhibit the overheating of the throttle body 10.

Owing to the above fact, in the case where the throttle body 10 is for a carburetor, it is possible to avoid the problem caused by the overheating of the throttle body 10, that the liquid fuel residual in the liquid fuel nozzle vaporizes to fill an interior area of the throttle passage with the result of making the fuel-air mixture too thick upon re-staring the engine to cause starting failure. Besides, in the event that the throttle body 10 is a portion for attaching an injector of an electronic fuel-injection device, it is possible to avoid the problem that a liquid fuel nozzle of the injector has its valve body agglutinated by carbide.

<Effect> It is possible to enhance the cooling efficiency of the cylinder and the cylinder head.

As shown in FIG. 4, the flow-dividing plate 9 has its bottom-plate portion 14 led out rearwardly. The thus led-out bottom-plate portion 14 covers the throttle body 10 from therebelow. Further, the left and right side-plate portions 15, 15 are conducted out rearwardly. The thus conducted-out side-plate portions 15, 15 cover the throttle body 10 from both of its left and right sides. Therefore, the cooling-air which tries to approach the throttle body 10 is shielded by the flow-dividing plate 9 to thereby deflect it toward the cylinders 3 and the cylinder heads 4. This makes it possible to enhance the cooling efficiency of the cylinders 3 and the cylinder heads 4.

<Effect> It is possible to alleviate the labor burden for cleaning the engine.

As illustrated in FIG. 2, the flow-dividing plate 9 has its bottom-plate portion 14 led out rearwardly. The thus led-out bottom-plate portion 14 covers the throttle body 10 from therebelow. Further, the left and right side-plate portions 15, 15 are conducted out rearwardly. The thus conducted-out side-plate portions 15, 15 cover the throttle body 10 from both of its left and right sides. Therefore, the flow-dividing plate 9 blocks the foreign matters from approaching the throttle body 10, thereby enabling the foreign matters to hardly bite a throttle input lever 62 or the like of the throttle body 10 as illustrated in FIG. 4. This can reduce the labor burden taken for cleaning the engine.

(Invention of Claim 13)

<Effect> The overheating of the throttle body can be inhibited.

As shown in FIGS. 3 and 4, a heat-insulating plate 20 is conducted out forwardly and covers the throttle body 10 from therebelow. Therefore, the heat-insulating plate 20 shields the hot air that floats up from an interior area of the fan case 5 toward the throttle body 10, just after the engine stopped so as to inhibit the hot air from entering the throttle body 10 from therebelow. This can prevent the overheating of the throttle body 10.

<Effect> It is possible to increase the cooling efficiency of the cylinder and the cylinder head.

As exemplified in FIGS. 3 and 4, the heat-insulating plate 20 is led out forwardly and the throttle body 10 is covered from therebelow. The heat-insulating plate 20 shields the cooling-air that tires to approach the throttle body 10 to thereby deflect it toward the cylinders 3 and the cylinder heads 4. This can make it possible to increase the cooling efficiency of the cylinders 3 and the cylinder heads 4.

<Effect> It is possible to alleviate the labor burden for cleaning the engine.

As shown in FIGS. 3 and 4, the heat-insulating plate 20 is conducted out forwardly and covers the throttle body 10 from therebelow. Therefore, the heat-insulating plate 20 blocks the foreign matters which try to approach the throttle body 10 and as a result the foreign matters hardly bite the throttle input lever 62 or the like of the throttle body 10. This can reduce the labor burden taken for cleaning the engine.

<Effect> Air-intake efficiency can be increased.

As exemplified in FIG. 4, the heat-insulating plate 20 is attached to a lower portion of an intake-air joint pipe 19, thereby enabling the heat-insulating plate 20 to shield the heat radiation from the cylinders 3 and the cylinder heads 4. This inhibits the overheating of the intake-air joint pipe 19 and besides the temperature increase of the intake air passing through the intake-air joint pipe 19. Thus the air-intake efficiency can be increased.

(Invention of Claim 4)

It offers the following effect in addition to that presented by the invention of claim 1.

<Effect> It is possible to alleviate the labor burden for cleaning the engine.

As illustrated in FIG. 1, the fan case 5 is formed into a structure divisible into an upper and a lower portions. Thus the case upper portion 5*a* can be removed while leaving the case lower portion 5*b* in the engine main body. In consequence, it is possible to clean out the foreign matters that have deposited in the fan case 5, around the throttle body 10 and within the central cooling-air passage 8. This can alleviate the labor burden for leaning the engine.

(Invention of Claim 5)

It offers the following effect in addition to that presented by the invention of claim 1.

<Effect> It is possible to alleviate the labor burden for cleaning the engine.

As shown in FIG. 1, in order to make left and right intake-air pipes 21, 21 span laterally between a front surface of the throttle body 10 and front surfaces of the left and right cylinder heads 4, 4, when seen from the front in a direction parallel to a crank-shaft center axis 1, the fan case 5 is divided so that a boundary 5*c* between the case upper and lower portions 5*a*, 5*b* transverse the front portions of the left and right intake-air pipes 21, 21 laterally. Thus in the case where the foreign matters bite a space between the fan case 5 and the left and right intake-air pipes 21, 21, even if the case upper portion 5*a* is dismantled, the foreign matters are retained while biting the space between the case lower portion 5*b* and the intake-air pipe 21 and therefore can be taken out upwardly or sucked out to easily remove them. This inhibits the disadvantage that the foreign matters are dispersed on the front floor of the case lower portion 5*b*, even if the case upper portion 5*a* is taken out, with the result of alleviating the labor burden for cleaning the engine.

Further, a conventional engine comprises a fan case whose split surface is arranged at a position lower than the left and right pipes. With this conventional engine, in the event that the foreign matters have bitten the space between the fan case and the left and right intake-air pipes, it caused a disadvantage that the foreign matters were dispersed on the front floor of the case lower portion.

(Invention of Claim 6)

It offers the following effect in addition to that presented by the invention of claim 5.

<Effect> It is possible to alleviate the labor burden for cleaning the engine.

As exemplified in FIG. 4, each of left and right side-plate portions 15, 15 is divided into an upper and a lower portions. The case upper portion 5*a* is provided with side-plate upper portions 15*a*, 15*a* and the case lower portion 5*b* is formed with side-plate lower portions 15*b*, 15*b*. The left and right side-plate portions 15, 15 of the flow-dividing plate 9 are divided up and down by removing the case upper portion 5*a* to result in facilitating the removale of the foreign matters deposited around the flow-dividing plate 9. This can alleviate the labor burden taken for cleaning the engine.

<Effect> It is possible to keep the high cooling efficiency of the cylinder and the cylinder head.

As illustrated in FIG. 4, the left and right intake-air pipes 21 are provided with flanges 22, each of which covers an engaging gap 16*a* between an engaging concaved portion 16 and each of the intake-air pipes 21 from a lateral side thereof. Therefore, the flange 22 blocks the cooling air which tries to enter from the engaging gap 16*a* toward the throttle body 10 to deflect it toward the cylinders 3 and the cylinder heads 4. This can maintain the high cooling efficiency of the cylinders 3 and the cylinder heads 4.

(Invention of Claim 7)

It offers the following effect in addition to that presented by the invention of claim 4.

<Effect> It is possible to enhance the durability of the fan case.

As exemplified in FIG. 1, the case lower portion 5*b* is fixed to the crank case 2 and the case upper portion 5*a* is fixed to the cylinder head 4. As shown in FIG. 4, a boundary elastic seal 24 is held between the case lower portion 5*b* and the case upper portion 5*a*. This boundary elastic seal 24 absorbs a stress applied to the case lower portion 5*b* and the case upper portion 5*a* by the heat-contraction of the engine main body after the engine has stopped its operation. This can reduce the stress applied to each of the attaching portions of the case lower portion 5*b* and the case upper portion 5*a*. Therefore, it is possible to inhibit the damage the case lower portion 5*b* and the case upper portion 5*a* undergo, with result of being able to enhance the durability of the fan case 5.

(Invention of Claim 8)

It offers the following effect in addition to that presented by the invention of claim 7.

<Effect> It is possible to facilitate the seal-attaching work.

As shown in FIG. 12(A), the case lower portion 5*b* has a front surface to which a front elastic seal 26 surrounding a case air-sucking port 25 is attached. As illustrated in FIG. 5(A) to FIG. 5(C), this front elastic seal 26 has an upper edge portion 26*a* integrally formed with the boundary elastic seal 24. Accordingly, as shown in FIG. 4, the elastic boundary seal 24 is spontaneously arranged at an optimum position of the butting surface of the case lower portion 5*b* only by attaching the front elastic seal 26 to the front surface of the case lower portion 5*b*. This dispenses with the positioning of the elastic boundary seal 24 to entail a possibility of easily performing the seal-attaching work.

(Invention of Claim 9)

It offers the following effect in addition to that presented by the invention of claim 1.

<Effect> It is possible to enhance the cooling efficiency of the cylinder and the cylinder head.

As exemplified in FIGS. 3 and 13, the left and right cylinder heads 4, 4 have upper portions 59, 59 between which a ceiling plate 41 of the air passage spans. This air-passage ceiling plate 41 covers the central cooling-air passage 8 from above, so that the cooling air which tries to float up from the central cooling-air passage 8 is shielded by the passage ceiling plate 41 to hardly leak out of the central cooling-air passage 8 with the result of increasing the amount of cooling air which passes through the central cooling-air passage 8. The air-passage ceiling plate 41 has left and right side edge portions 60, 60 detachably attached to the upper portions 59, 59 of the cylinder heads 4, 4, thereby enabling the heat of the cylinder head 4 to be radiated through the air-passage ceiling plate 41. For these reasons, it is possible to enhance the cooling efficiency of the cylinders 3 and the cylinder heads 4.

<Effect> It is possible to reduce the labor burden taken for cleaning the engine.

As exemplified in FIGS. 3 and 13, the left and right cylinder heads 4, 4 have the upper portions 59, 59 between which the ceiling plate 41 of the air passage spans. This air-passage ceiling plate 41 covers the central cooling-air passage 8 from above, so that the foreign matters falling down from above are blocked by the air-passage ceiling plate 41 to inhibit the deposition of the foreign mattes within the central cooling-air passage 8. The air-passage ceiling plate 41 has left and right side edge portions 60, 60 detachably attached to the upper portions 59, 59 of the cylinder heads 4, 4, thereby enabling the foreign maters to be readily removed by taking out the air-passage ceiling plate 41 even if the foreign matters that have entered from the fan case 5 may deposit within the central cooling-air passage 8. Thus it is possible to reduce the labor burden taken for cleaning the engine.

(Invention of Claim 10)

It offers the following effect in addition to that presented by the invention of claim 9.

<Effect> It is possible to enhance the cooling efficiency of the cylinder and the cylinder head.

As shown in FIGS. 3 and 13, the air-passage ceiling plate 41 has its left and right side edge portions 60, 60 made to extend along the upper portions 59, 59 of the left and right cylinder heads 4, 4. This can inhibit the cooling air from leaking out of lateral sides of the left and right side edge portions 60, 60 of the air-passage ceiling plate 41 to entail the possibility of enhancing the cooling efficiency of the cylinders 3 and the cylinder heads 4.

<Effect> It is possible to reduce the labor burden taken for cleaning the engine.

As exemplified in FIGS. 3 and 13, the air-passage ceiling plate 41 has its left and right side edge portions 60, 60 made to extend along the upper portions 59, 59 of the left and right cylinder heads 4, 4. This can inhibit the entrance of the foreign matters from the lateral sides of the left and right side edge portions 60, 60 of the air-passage ceiling plate 41 into the central cooling-air passage 8 to prevent the deposition of the foreign matters within the central cooling-air passage 8. This can reduce the labor burden taken for cleaning the engine.

(Invention of Claim 11)

It offers the following effect in addition to that presented by the invention of claim 9.

<Effect> It is possible to enhance the cooling efficiency of an exhaust muffler.

As illustrated in FIG. 2, the cooling air that has passed through the central cooling-air passage 8 is arranged to be introduced into a muffler cover 38, thereby allowing the cooling air, which is inhibited from escaping upwards by the air-passage ceiling plate 41, to pass through the central cooling-air passage 8 so as to be efficiently supplied into the muffler cover 38. Thus it is possible to enhance the cooling efficiency of the exhaust muffler 37.

(Invention of Claim 12)

It offers the following effect in addition to that presented by the invention of claim 11.

<Effect> It is possible to increase the durability of the muffler cover.

As exemplified in FIG. 2, an extension plate 42 is conducted out of the air-passage ceiling plate 41 of the central air-passage 8 rearwardly. This extension plate 42 covers a ceiling plate 43 of the muffler cover 38 from thereabove. An air-radiation gap 50 is maintained between the extension plate 42 and the muffler-cover ceiling plate 43. The cooling air radiated from the cooling-air outlet 40 of the central cooling-air passage 8 is made to flow along an upper and a lower surfaces of the ceiling plate 43 of the muffler cover 38. This makes it possible to cool the ceiling plate 43 of the muffler cover 38 from above and below, which entails a high cooling efficiency of the muffler cover 38. Thus it is possible to increase the durability of the muffler cover 38.

<Effect> It is possible to accelerate the ventilation above the air-passage ceiling plate.

As shown in FIG. 2, the cooling air 44 that has passed through the air-radiation gap 50 is arranged to be released rearwardly along the upper surface of the muffler cover 43, thereby enabling the negative pressure produced by this cooling air 44 to suck out the hot air above the air-passage ceiling plate 41 rearwardly together with the cooling air 44. This can accelerate the ventilation above the air-passage ceiling plate 41. Consequently, in the case of housing the engine within a bonnet, the ventilation within the bonnet can be accelerated.

(Invention of Claim 13)

It offers the following effect in addition to that presented by the invention of claim 12.

<Effect> The air-intake efficiency can be enhanced.

As exemplified in FIGS. 2 and 13, an air cleaner 17 is arranged along the upper surface of the air-passage ceiling plate 41 of the central cooling-air passage 8. This promotes the ventilation around the air cleaner 17 to inhibit the overheating of the air cleaner 17 with the result of being able to lower the temperature of the air passing through the air cleaner 17. Thus the air-intake efficiency can be enhanced.

(Invention of Claim 14)

It offers the following effect in addition to that presented by the invention of claim 9.

<Effect> The air-intake efficiency can be enhanced.

As shown in FIG. 2, the air cleaner 17 has an inlet 46, which takes in the intake air, arranged opposite to the central cooling-air passage 8, thereby enabling the air cleaner 17 to take in the air of a low temperature so as to be able to increase the air-intake efficiency. Further, in the case where the supercharging effect can be obtained through feeding the air under pressure by the air-blowing fan 7, the air-intake efficiency can be further increased.

(Invention of Claim 15)

It offers the following effect in addition to that presented by the invention of claim 1.

<Effect> It is possible to increase the cooling efficiency of the cylinder and the cylinder head.

As shown in FIGS. 14(A) and 14(B), left and right lateral cooling-air passage plates 47, 47 are provided along lateral peripheral side walls of the left and right cylinders 3 and cylinder heads 4 on a side opposite to the central cooling-air passage 8 while holding the left and right cylinders 3 and cylinder heads 4 therebetween. A lateral cooling-air passage is formed within each of the lateral cooling-air passage plates 47. Each of the lateral cooling-air passages has a front end formed with a cooling-air inlet 48 which is communicated with the fan case 5. Thus the cylinders 3 and the cylinder heads 4 can be cooled as well by the cooling-air passing through the lateral cooling-air passage, thereby enabling the cylinders 3 and the cylinder heads 4 to be cooled with high efficiency.

(Invention of Claim 16)

It offers the following effect in addition to that presented by the invention of claim 15

<Effect> It is possible to enhance the cooling efficiency of the exhaust muffler.

As exemplified in FIGS. 14(A) and 14(B), each of rear cooling-air passages has a cooling-air outlet 51 oriented to the cooling-air outlet 40 of the central cooling-air passage 8, thereby allowing the exhaust muffler 37 to be also cooled by the cooling air that has passed through the rear cooling-air passage. This can enhance the cooling efficiency of the exhaust muffler 37.

<Effect> It is possible to increase the cooling efficiency of the cylinder and the cylinder head.

As shown in FIG. 14(A), conducted out of rear end portions of the left and right lateral cooling-air passage plates 47, 47 are left and right rear cooling-air passage plates 49, 49 extending along the rear peripheral wall surfaces of the left and right cylinders 3 and cylinder heads 4. A rear cooling-air passage is formed within each of the rear cooling-air passage plates 49. Therefore, the cylinders 3 and the cylinder heads 4 are cooled by the cooling air passing through the rear cooling-air passage as well. This can increase the cooling efficiency of the cylinders 3 and the cylinder heads 4.

(Invention of Claim 17)

It offers the following effect in addition to that presented by the invention of claim 15

<Effect> It is possible to increase the durability of a grommet and electric cords.

As shown in FIGS. 10(A) and 14(B), an annular grommet 53 is attached to at least one of the left and right lateral cooling-air passage plates 47, 47. A plurality of electric cords 54 are inserted into this grommet 53 for supporting the latter. Thus the heat that has been transmitted from the cylinder 3 and the cylinder head 4 to the lateral cooling-air passage 47 is radiated into the cooling air passing through the lateral cooling-air passage to be hardly transmitted to the grommet 53 and the electric cords 54. This can enhance the durability of the grommet and the electric cords.

(Invention of Claim 18)

It offers the following effect in addition to that presented by the invention of claim 17.

<Effect> It is possible to increase the durability of the grommet and the electric cords.

As shown in FIGS. 10(A) and 14(B), the grommet 53 is arranged at a front end edge portion 55 of the lateral cooling-air passage plate 47 opposite to an interior area of the fan case 5. Therefore, the heat that has been transmitted from the cylinder 3 and the cylinder head 4 to the lateral cooling-air passage plate 47 is radiated to the cooling air within the fan case 5, thereby enabling it to be hardly transmitted to the grommet 53 and the electric cords 54. This can enhance the durability of the grommet 53 and the electric cords 54.

(Invention of Claim 19)

It offers the following effect in addition to that presented by the invention of claim 18.

<Effect> It is possible to alleviate the labor burden for cleaning the engine.

As exemplified in FIGS. 10(A), 10(B) and 14(B), the lateral cooling-air passage plate 47 has the front end edge portion 55 provided with a notch 56, along which the grommet 53 is moved radially thereof so that the grommet 53 can be detachably attached to the notch 56 with the electric cords 54 inserted therethrough. Thus if the foreign matters have deposited within the lateral cooling-air passage, the grommet 53 is taken out of the lateral cooling-air passage plate 47 along the notch 56 with the electric cords 54 inserted therethrough and the lateral cooling-air passage plate 47 is removed from the engine main body for removing the foreign matters. Thereafter, the grommet 53 with the electric cords 54 inserted therethrough is attached to the notch 56, thereby enabling it to be attached to the lateral cooling-air passage plate 47. This can alleviate the labor burden taken for cleaning the engine.

(Invention of Claim 20)

It offers the following effect in addition to that presented by the invention of claim 1.

<Effect> It is possible to alleviate the labor burden for cleaning the engine.

As shown in FIG. 11(A), attached to inlet portions 29 of the left and right intake-air pipes 21, 21 is a throttle body 10 from a rear portion of the latter through a plurality of screw fasteners, which is composed of one stud bolt 27 and headed bolts 28 as the remaining ones. Accordingly, in the event that the foreign matters have deposited between the throttle body 10 and the crank case 2, nuts are taken out of the headed bolts 28 and the stud bolt 27, and then a position of the throttle body 10 is inclined around the stud bolt 27, thereby enabling the foreign matters to be easily removed. This can reduce the labor burden taken for cleaning the engine.

<Effect> It is possible to easily attach the throttle body.

As exemplified in FIG. 11(A), when the throttle body 10 is attached to the inlet portions 29 of the left and right intake-air pipes 21, 21 from the rear thereof, the stud bolt 27 can make the positioning of a portion of the throttle body 10 with the result of being able to attach the throttle body 10 easily.

(Invention of Claim 21)

It offers the following effect in addition to that presented by the invention of claim 20.

<Effect> It is possible to easily attach the throttle body.

As shown in FIGS. 11(A) and 11(B), gasket-support pins 31 project from the inlet portions 29 of the left and right intake-air pipes 21, 21 and are inserted through gaskets 30, 30. Thus even if the headed bolts 28 are removed from the gaskets 30, 30, the gaskets 30, 30 with the stud bolts 27 inserted therethrough are prevented from rotating by the gasket-support pins 31. Consequently, in case of attaching the throttle body 10 detachably to the inlet portions 29 of the left and right intake-air pipes 21, 21, it is possible to retain the gaskets 30, 30 at an optimum attaching position. This can make it easy to perform the attaching work of the throttle body 10.

(Invention of Claim 22)

It offers the following effect in addition to that presented by the invention of claim 20.

<Effect> It is possible to reduce the total height of the engine.

As illustrated in FIG. 2, the central cooling-air passage 8 has a rear portion provided with a projection 32 which houses an upper portion of the timing transmission device 58. The projection 32 is made to project upwards from a ceiling wall 23 of the crank case 2. A liquid-fuel chamber 33 is attached to a lower portion of the throttle body 10 in front of this projection 32 and is provided vertically downwardly to a position lower than the uppermost portion of the projection 32 with the result of being able to reduce the entire height of the engine.

<Effect> There is caused no problem upon removing the throttle body.

As shown in FIG. 11(A), the stud bolt 27 is arranged at a position higher than the uppermost portion of the projection 32. The liquid-fuel chamber 33 is arranged at a position where it does not interfere with the projection 32 by rotating the throttle body 10 around the stud bolt 27, so that the throttle body 10 can be extracted out of the stud bolt 27 rearwardly. Therefore, in spite of the fact that the liquid-fuel chamber 33 is provided vertically downwardly to the position lower than the uppermost portion of the projection 32, there is caused no problem when removing the throttle body 10.

(Invention of Claim 23)

It offers the following effect in addition to that presented by the invention of claim 1.

<Effect> It is possible to alleviate the labor burden for cleaning the engine.

As shown in FIG. 14(A), a fuel-drain tube 35 has a terminal end portion closed by a pin 36 for supporting the tube terminal end. This can prevent the foreign matters from clogging the terminal end portion of the fuel-drain tube 35 with the result of alleviating the labor burden taken for cleaning the engine.

<Effect> It is possible to inhibit the floor from becoming dirty by a wrong operation of a fuel cock.

As shown in FIG. 14(A), the fuel-drain tube 35 has the terminal end portion closed by the pin 36 for supporting the tube terminal end. Therefore, even if the wrong operation of the fuel cock 34 caused the liquid fuel to flow into the drain tube 36, the liquid fuel does not flow out of the terminal end portion of the fuel-drain tube 35, thereby enabling the floor not to become dirty by the wrong operation of the fuel cock 34.

<Effect> It is possible to prevent the fuel-drain tube from being damaged.

As exemplified in FIG. 14(A), attached to an engine's wall is the tube terminal-end support pin 36, into which the fuel-drain tube 35 has its terminal end portion removably fitted. This limits the pivotal movement of the fuel-drain tube 35 when the engine is in operation, thereby inhibiting the disadvantage that the fuel-drain tube 35 collides against its surrounding portions, with the result of being able to prohibit the fuel-drain tube 35 from being damaged.

<Effect> It is possible to prevent the loss of the tube terminal-end support pin which serves as a sealing plug for the fuel-drain tube.

As exemplified in FIG. 14(A), the tube terminal-end support pin 36 is attached to the engine's wall. This can prevent the loss of the tube terminal-end support pin 36 which serves as the sealing plug for the fuel-drain tube 35.

(Invention of Claim 24)

It offers the following effect in addition to that presented by the invention of claim 1.

<Effect> It is possible to inhibit the occurrence of the vapor lock within the fuel supply passage.

As illustrated in FIG. 1, there is arranged within the fan case 5 a fuel supply pump 81 which supplies the fuel to a side of the throttle body 10, thereby enabling the cooling air generated by the air-blowing fan 7 to positively cool the fuel supply pump 81. In consequence, even with bad ventilation effected within the bonnet housing the engine, the fuel supply pump 81 has its temperature kept lower to entail the possibility of inhibiting the occurrence of the vapor lock in the fuel supply passage.

<Effect> It is possible to reduce the total height of the engine.

As shown in FIG. 1, there is disposed within the fan case 5 the fuel supply pump 81 for feeding the fuel to a carburetor 80. This can reduce the total height of the engine in proportion to the reduction of upward projection of the fuel supply pump 81 from the fan case 5 and the head cover 68.

(Inventor of Claim 25 or 26)

It offers the following effect in addition to that presented by the invention of claim 24.

<Effect> It is possible to clean an interior area of the fan case easily.

As exemplified in FIG. 1, the case upper portion 5*a* is removable without taking out the fuel supply pump 81 through attaching the fuel supply pump 81 to the engine main body or the case lower portion 5*b*. In consequence, the case upper portion 5*a* can be taken out without being interfered by the fuel supply pump 81 with the result of easily cleaning the interior area of the fan casing 5.

(Invention of Claim 27)

It offers the following effect in addition to that presented by the invention of claim 24.

<Effect> It is possible to inhibit the occurrence of the vapor lock within the fuel supply passage.

As shown in FIG. 1, an attaching plate 82 is arranged at a position against which the divided flows of the cooling air blow and the fuel supply pump 81 is attached to this attaching plate 82. Thus this attaching plate 82 is vigorously cooled by the cooling air, thereby enabling the fuel supply pump 81 attached to the attaching plate 82 to be cooled with a high efficiency. This results in the possibility of inhibiting the occurrence of the vapor lock within the fuel supply passage.

(Invention of Claim 28)

It offers the following effect in addition to that presented by the invention of claim 27.

<Effect> It is possible to inhibit the occurrence of the vapor lock within the fuel supply passage.

As illustrated in FIG. 1, one of the respective side-plate upper portions 15*a*, 15*a* is conducted out of the attaching plate 82, so that the cooling air which has contacted the side-plate upper portion 15*a* intensively cools the attaching plate 82. This results in an enhanced cooling efficiency of the fuel supply pump 81 attached to the attaching plate 82. Therefore, it is possible to inhibit the occurrence of the vapor lock within the fuel supply passage.

(Invention of Claim 29)

It offers the following effect in addition to that presented by the invention of claim 1.

<Effect> It is possible to inhibit the starting failure of the engine.

The fuel supply pump 81 is covered with the attaching plate 82 from therebelow. Accordingly, the hot air which tries to approach the fuel supply pump 81 is shielded by the attaching plate 82 to thereby inhibit the entrance of the hot air from below the fuel supply pump 81 with the result of being able to prevent the overheating of the fuel supply pump 81 as well.

In consequence, it is possible to prevent the starting failure of the engine attributable to the occurrence of the vapor lock within the fuel supply passage.

<Effect> It is possible to increase the cooling efficiency of the cylinder and the cylinder head.

The fuel supply pump 81 is covered with the attaching plate 82 from therebelow. Accordingly, the hot air which tries to approach the fuel supply pump 81 is shielded by the attaching plate 82 to thereby deflect it toward the cylinders 3 and the cylinder heads 4 with the result of being able to increase the cooling efficiency of the cylinders 3 and the cylinder heads 4.

BRIEF DESCRIPTION OF THE DRAWINGS

[FIG. 3] is a top view of the engine shown in FIG. 1 with an upper portion of the fan case removed and a ceiling plate of an air-passage made see-through;

[FIG. 5] shows a seal to be used in the engine of FIG. 1.

[FIG. 6] shows the air-passage ceiling plate to be used in the engine of FIG. 1.

[FIG. 9] shows a muffler cover to be used in the engine of FIG. 1.

[FIG. 10] shows a lateral cooling-air passage plate and a grommet to be used in FIG. 1.

[FIG. 11] shows how to attach a throttle body to be used in the engine of FIG. 1.

[FIG. 12] shows the engine of FIG. 1.

[FIG. 14] shows the engine of FIG. 1.

MOST PREFERRED EMBODIMENT OF THE INVENTION

An embodiment of the present invention is explained based on the attached drawings. FIGS. 1 to 14 show a V-shaped air-cooled engine according to the embodiment of the present invention. In this embodiment, an explanation is given for a V-shaped air-cooled gasoline two-cylinder engine with a carburetor. This engine, for example, is suitably applicable to a weed mower and a lawn mower.

The embodiment of the present invention is outlined as follows.

Figure 1:
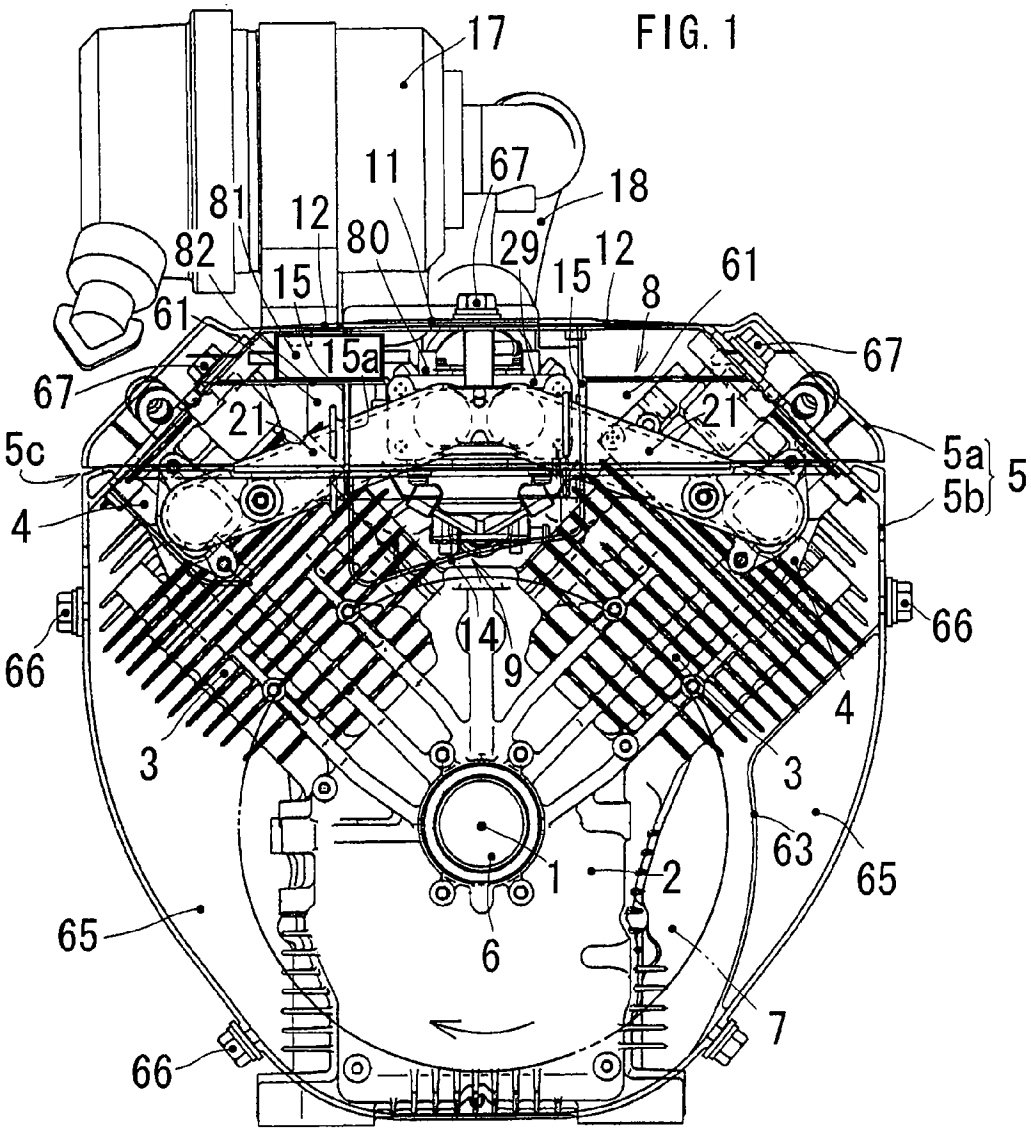
[FIG. 1] shows a V-shaped air-cooled engine according to an embodiment of the present invention and is a front view, in vertical section, of a fan case.

As shown in FIG. 1, when seen from the front in a direction parallel to a crank-shaft center axis 1, cylinders 3 project from a crank case 2 obliquely upwardly in a left and right direction, respectively. Each of the cylinders 3 has a projecting end to which a cylinder head 4 is attached to form an engine main body. A fan case 5 is attached in front of the engine main body and houses an air-blowing fan 7. A central cooling-air passage 8 is formed between the left and right cylinders 3, 3 as well as between the left and right cylinder heads 4, 4. Cooling air generated by the air-blowing fan 7 is fed to the central cooling-air passage 8. The air-blowing fan 7 is a centrifugal fan and is attached to a crank shaft 6. Each of the cylinders 3, 3 is projected obliquely upwards at an angle of incidence of 45 degrees.

Figure 2:
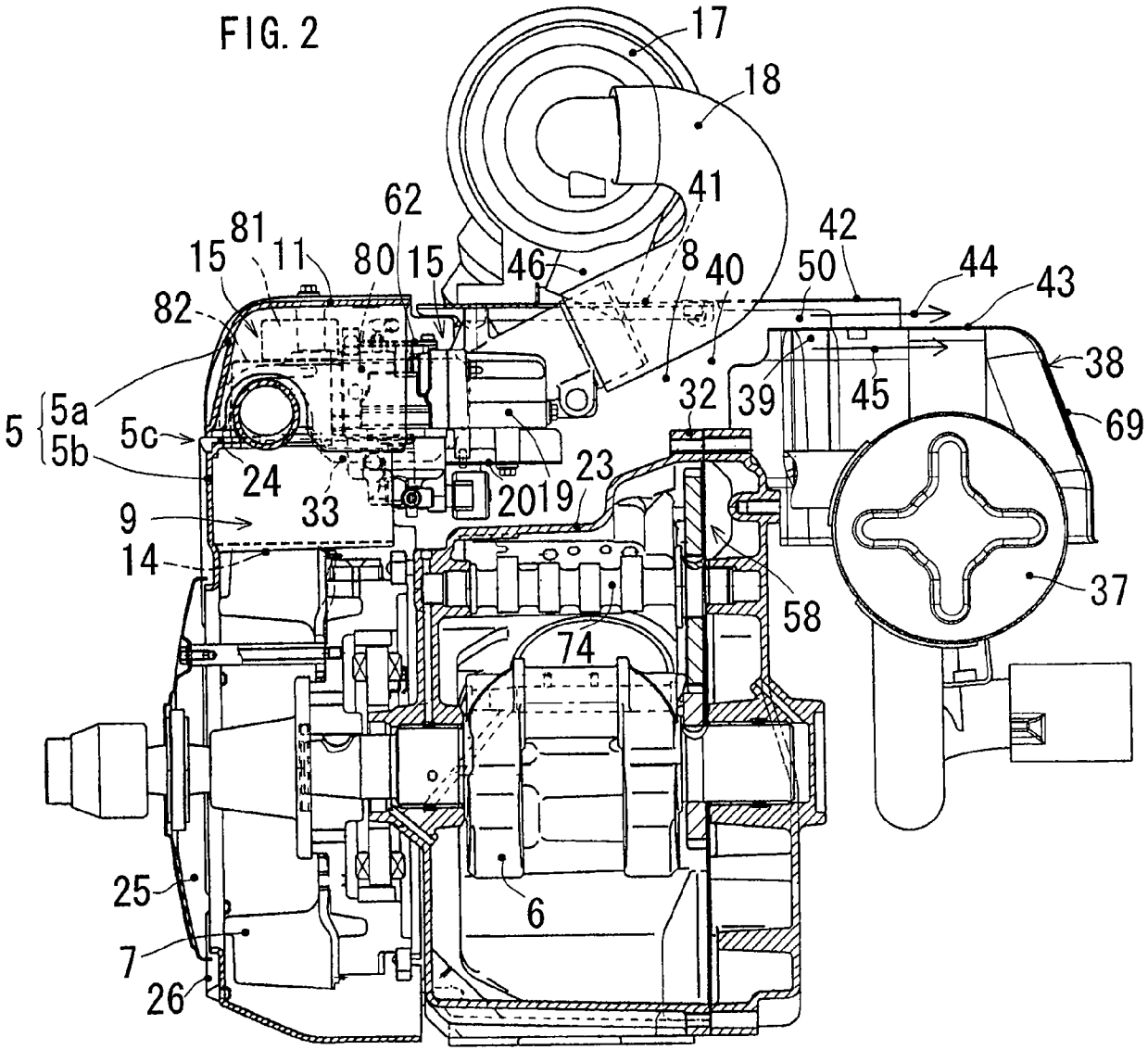
[FIG. 2] is a vertical sectional side view of the engine shown in FIG. 1.

As shown in FIG. 2, a throttle body 10 and a flow-dividing plate 9 are arranged ahead of the central cooling-air passage 8. The flow-dividing plate 9 is provided in the fan case 5 at a position forwardly of the throttle body 10 and has a bottom-plate portion 14 arranged at a position lower than the throttle body 10. The flow-dividing plate 9 divides the cooling air produced by the air-blowing fan 7 toward the left and right sides.

The throttle body 10 is for a carburetor and has a lower portion provided with a liquid-fuel chamber 33. The flow-dividing plate 9 serves as a flow-divider and as a first shut-off plate defining a first shut-off point of the fan case 5. The fan case 5 has an interior area provided with a second shut-off plate 63 defining a second shut-off point.

An upper portion of the fan case is devised as follows.

As shown in FIG. 1, the fan case 5 has a ceiling wall a mid portion 11 of which is arranged just above the bottom-plate portion 14 of the flow-dividing plate 9. The mid portion 11 of the ceiling wall of this flow-dividing plate 9 is provided at a position higher than the throttle body 10 as well as the mid side portions 12, 12 of the ceiling wall, conducted out of the mid portion 11 in the left and right direction. As shown in FIG. 1, on the projected drawing whose surface is in parallel to the crank-shaft center axis 1, the mid portion 11 and the central side portions 12, 12 of the ceiling wall, which are provided at a position higher than the throttle body 10, have a total lateral width extending over the whole area between upper portions of the cylinder heads 3, 3. As for the total lateral width of the mid portion 11 and the mid side portions 12, 12 of the ceiling wall, from an aspect of widening outlets 61, 61 for blowing air from the upper portion of the fan case 5 to the central cooling-air passage 8, with a lateral width of the whole area between the upper portions of the cylinder heads 3 and 3 taken as 100%, it should be preferably at least 70%, more preferably at least 80%, and most preferably at least 90%.

The flow-dividing plate is devised as follows.

Figure 4:
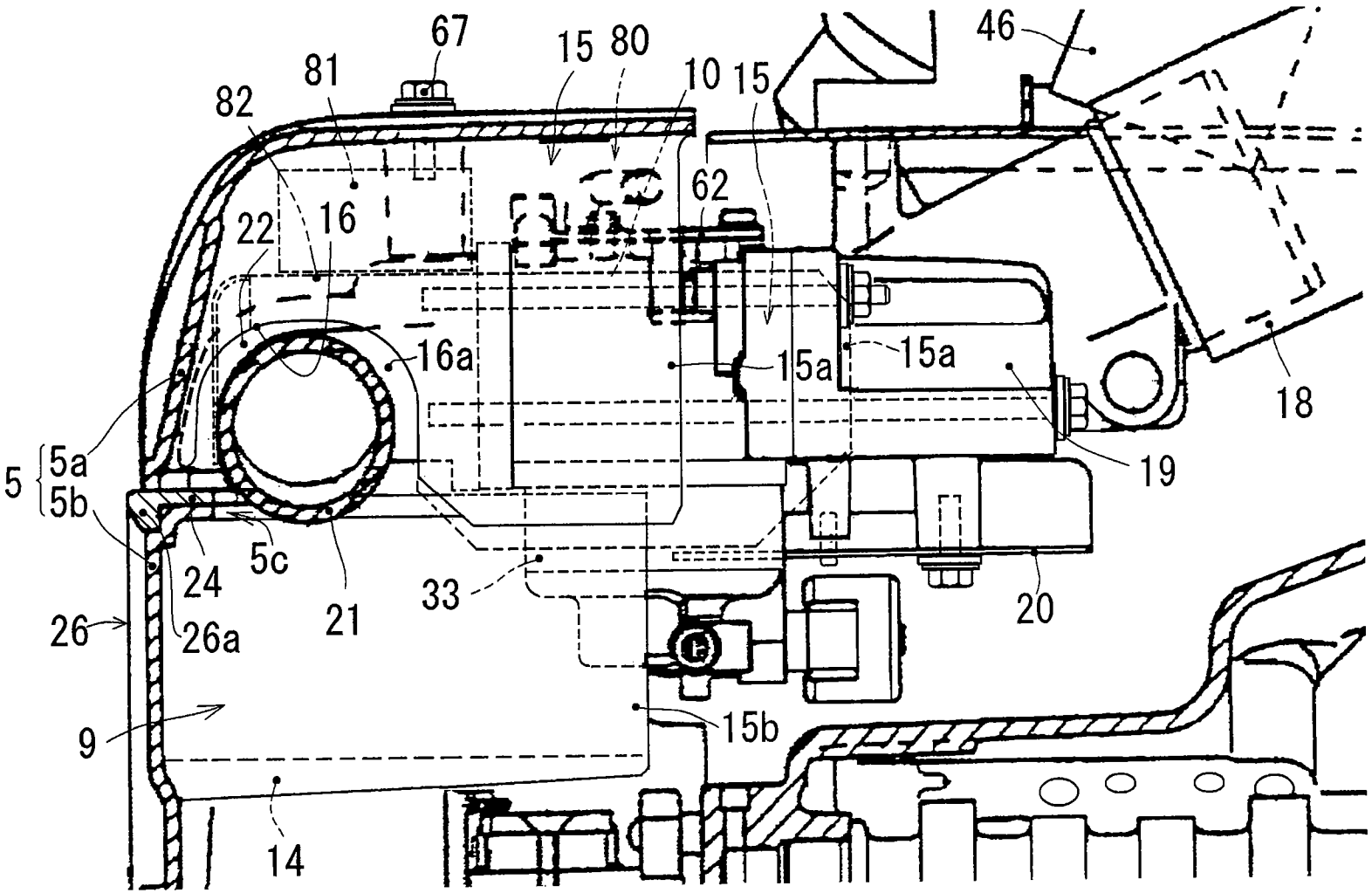
[FIG. 4] is a vertical sectional side view of a throttle body and its surrounding portions of the engine shown in FIG. 1.

As shown in FIG. 1, the flow-dividing plate 9 is composed of the bottom-plate portion 14 and left and right side-plate portions 15, 15. The left and right side-plate portions 15, 15 are arranged above the opposite end portions of the bottom-plate portion 14. As shown in FIG. 4, the flow-dividing plate 9 has its bottom-plate portion 14 conducted out rearwadly. The thus conducted-out bottom-plate portion 14 covers the throttle body 10 from therebelow. Further, the left and right side-plate portions 15, 15 are rearwardly led out. The thus led-out side-plate portions 15, 15 cover the throttle body 10 from the left and right opposite end portions of the latter. The left and right side-plate portions 15, 15 are conducted out of the left and right opposite end portions of the bottom-plate portions 14 at an angle of incidence of 90 degrees, i.e., vertically upwardly. From the aspect of widening the outlets 61, 61 for blowing air from the upper portion of the fan case 5 to the central cooling-air passage 8, the left and right side-plate portions 15, 15 are upwardly conducted out at an angle of incidence larger than the cylinders 3, 3. When seen from the front in the direction parallel to the crank-shaft center axis 1, an upwardly flaring wedge-shaped air-blowing outlets 61, 61 are formed between the left and right side-plate portions 15, 15 and the cylinders 3, 3.

The bottom-plate portion 14 and the right side-plate portion 15 cover a lower portion and a right side of a front half portion of the liquid-fuel chamber 33 of the throttle body 10, while the left side-plate portion 15 covers substantially the whole area of the liquid-fuel chamber 33 of the throttle body 10.

As shown in FIG. 2, an intake-air hose 18 is conducted out of an air cleaner 17. Between the left and right cylinder heads 4, 4, attached to a rear portion of the throttle body 10 is an intake-air joint pipe 19 for connecting the intake-air hose 18. A heat-insulating plate 20 is attached to a lower portion of the intake-air joint pipe 19. As shown in FIG. 4, this heat-insulating plate 20 is led out forwardly to cover the throttle body 10 from therebelow.

Figure 3:
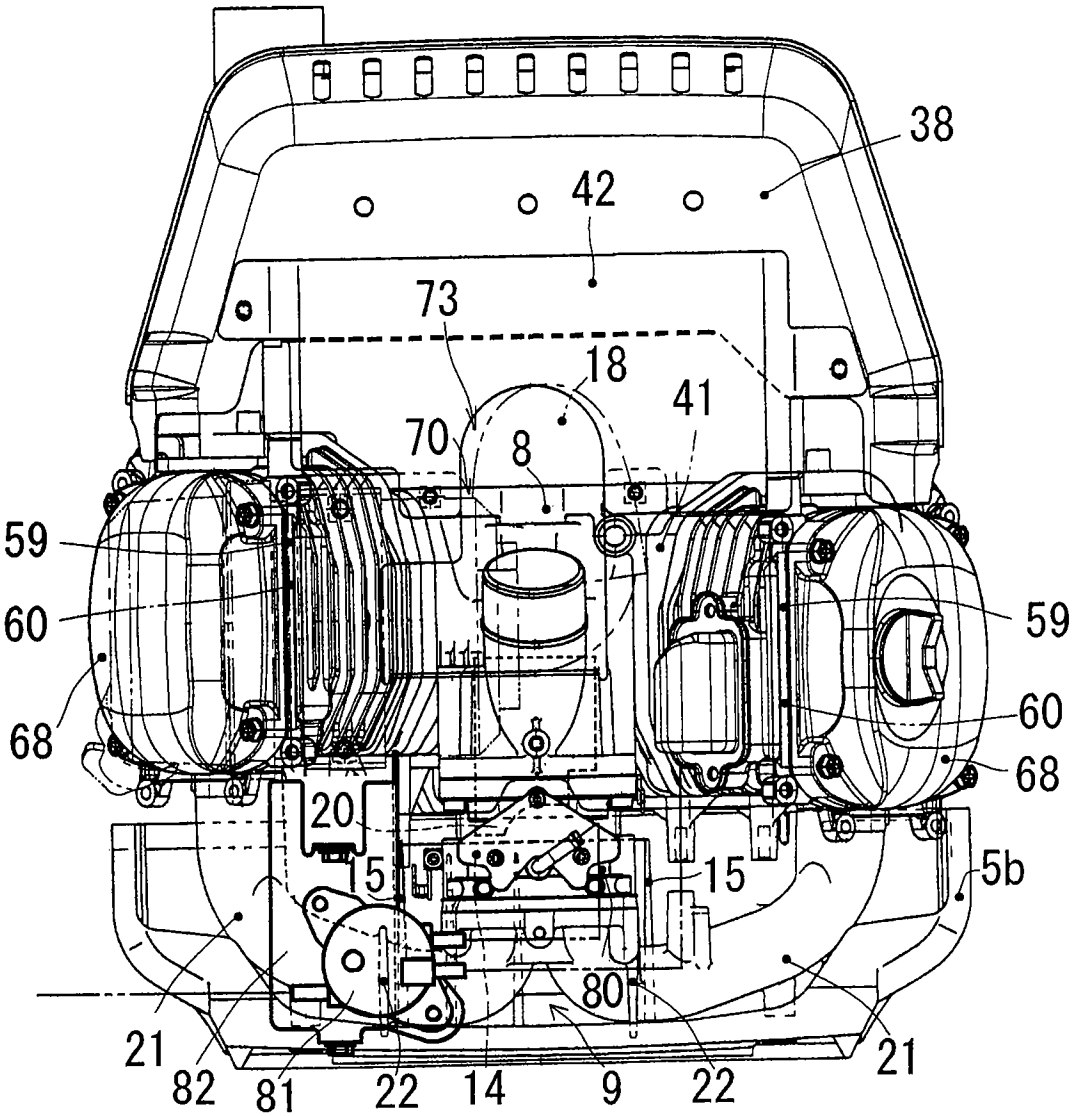

This heat-insulating plate 20 coves a lower portion of a rear half portion of the throttle body 10. More specifically, as shown in FIG. 3, the bottom-plate portion 14 of the flow-dividing plate 9 and the heat-insulating plate 20 cover the front and rear half portions of the throttle body 10 from therebelow.

The fan case is devised as follows.

As shown in FIG. 4, the fan case 5 is formed into a structure divisible into an upper and a lower portions so that the case upper portion 5*a* can be removed while leaving the case lower portion 5*b* in the engine main body.

As shown in FIG. 1, in order to make the left and right intake-air pipes 21, 21 laterally span between a front surface of the throttle body 10 and front surfaces of the left and right cylinder heads 4, 4, when seen from the front in the direction parallel to the crank-shaft center axis 1, the fan case 5 is divided so that a boundary 5*c* between the case upper and lower portions 5*a*, 5*b* crosses a forward portion of the left and right intake-air pipes 21, 21 laterally.

When seen from the front in the direction parallel to the crank-shaft center axis 1, the left and right intake-air pipes 21, 21 are inclined downwardly from the front surface of the throttle body 10 to the left and right sides at an angle of declination of 20 degrees. The boundary 5*c* is oriented laterally in a horizontal direction. From the view-point of retaining the foreign matters while they are biting a space between the case lower portion 5*b* and the intake-air pipe 21 even if the case upper portion 5*a* is taken out, the left and right intake-air pipes 21, 21 are advantageously positioned horizontally or at an angle of declination within a range of 0 to 30 degrees.

As shown in FIG. 3, in order to form the flow-dividing plate 9 from the bottom-plate portion 14 and the left and right side-plate portions 15, 15 and to insert the left and right intake-air pipes 21, 21 through the left and right side-plate portions 15, 15, the following arrangement is made.

More specifically, as shown in FIG. 4, the left and right side-plate portions 15, 15 are also divided into an upper and a lower portions. While the side-plate upper portions 15*a*, 15*a* are provided within the case upper portion 5*a*, the side-plate lower portions 15*b*, 15*b* are disposed within the case lower portion 5*b*. At least one of the side-plate upper portions 15*a*, 15*a* and the side-plate lower portions 15*b*, 15*b* are provided with left and right fitting concaved portions 16, 16. Each of the intake-air pipes 21 is fitted into each of the fitting concaved portions 16. Every intake-air pipe 21 is provided with a flange 22, which covers every fitting gap 16*a* between the fitting concaved portion 16 and the intake-air pipe 21 from its lateral side.

A device is made to a structure for attaching the fan case and to the seal.

As shown in FIG. 4, the case lower portion 5*b* is fixed to the crank case 2 and the case upper portion 5*a* is fixed to the cylinder head 4. The case lower portion 5*b* and the case upper portion 5*a*, which are arranged opposite to the boundary 5*c*, butt against each other and their butting surfaces hold a boundary elastic seal 24 therebetween.

The case lower-half portion 5*b* is detachably attached to left and right rear plates 65, 65 attached to the crank case 2 by means of bolts 66, 66. The rear plates 65, 65 are plates for covering a rear surface of the case lower-half portion 5*b*. The case upper-half portion 5*a* is detachably attached to the cylinder heads 4, 4 and the inlet portions 29 of the intake-air pipes 21, 21. Although the case upper-half portion 5*a* is directly fixed to the cylinder head 4 by directly attaching it to the cylinder head 4, it may be indirectly secured to the cylinder head 4 by attaching it to the head cover 4.

Figures 5A, 5B, 5C, 5D:
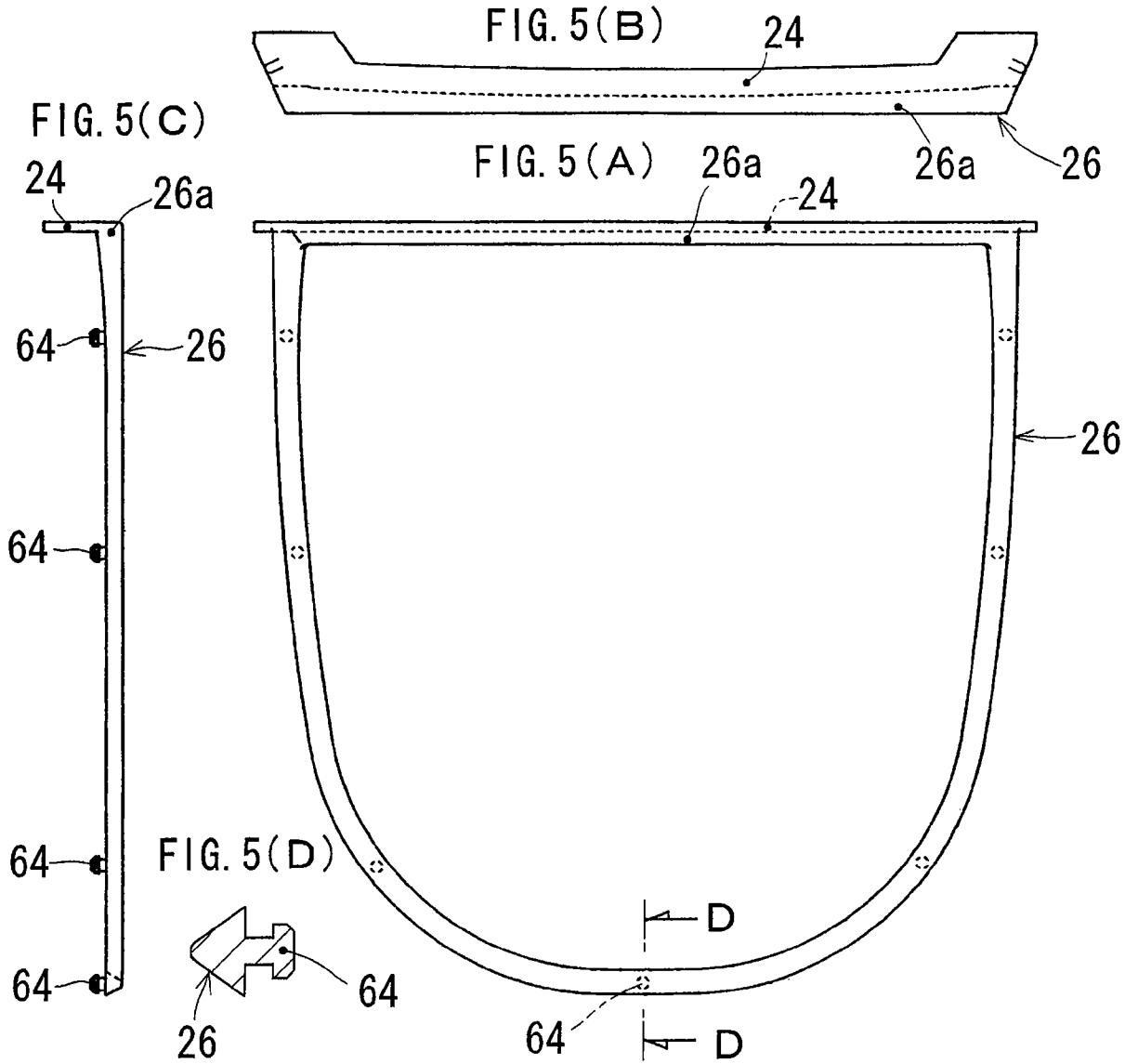
FIG. 5(A), FIG. 5(B), FIG. 5(C) and FIG. 5(D) are a front view, a top view, a side view and a sectional view taken along a line D-D.
Figure 12A:
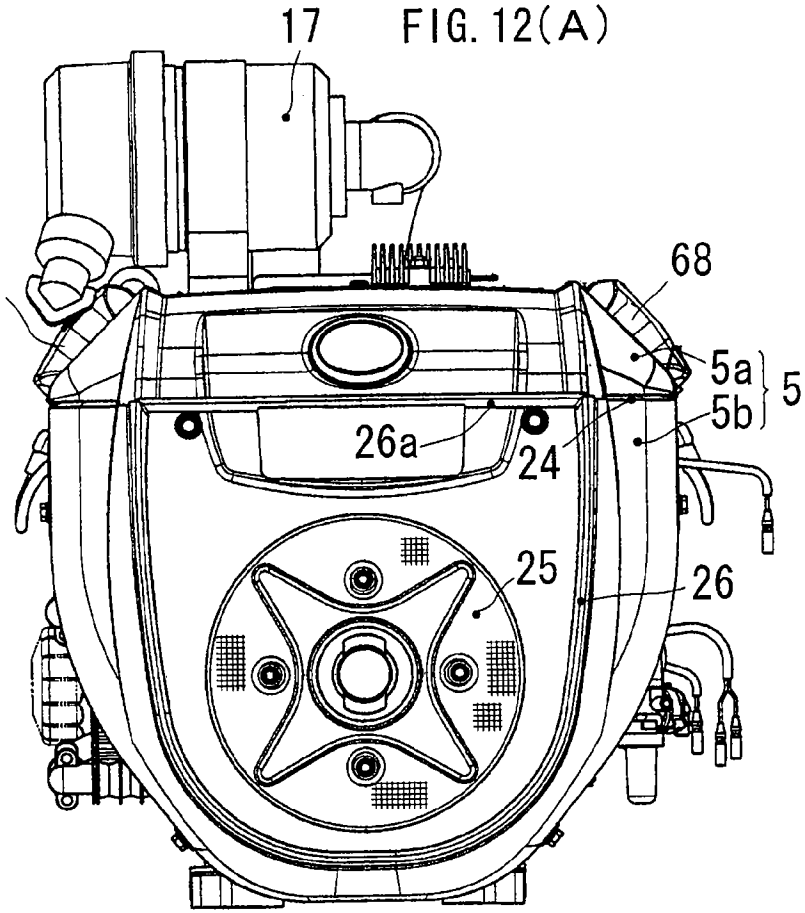
FIG. 12(A) is a front view and FIG. 12(B) is a left side view.
Figure 12B:
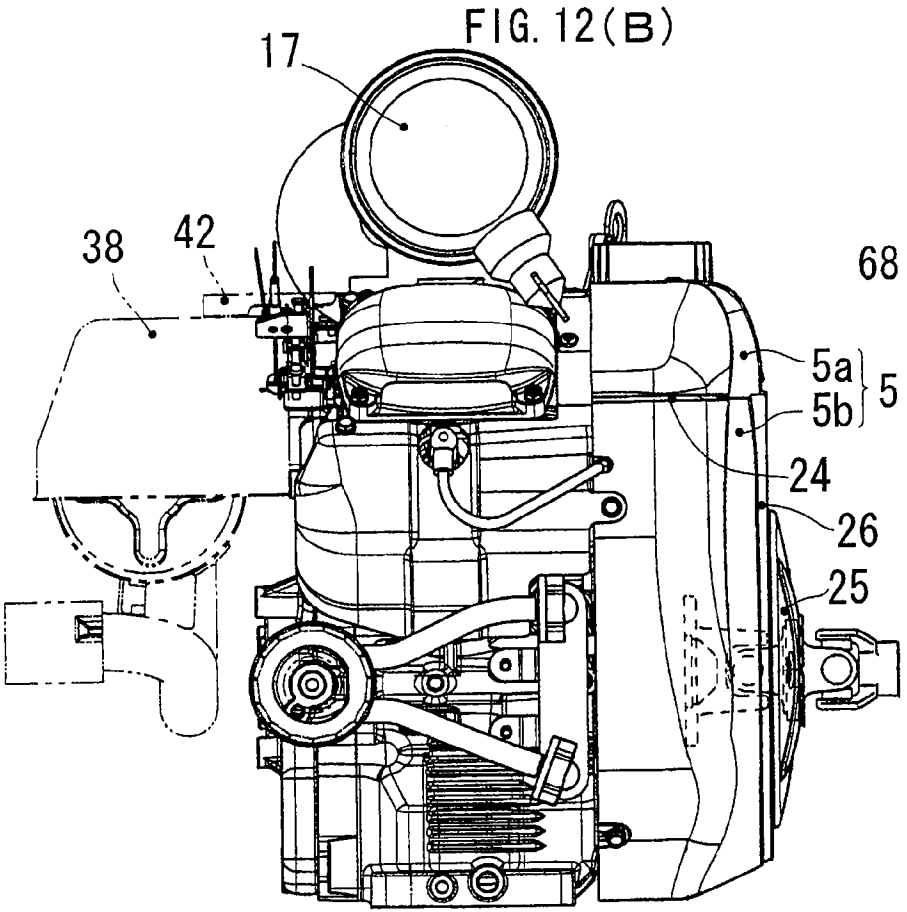

As shown in FIG. 12(A), the case lower portion 5*b* has a front surface to which a front elastic seal 26 surrounding a case air-sucking port 25 is attached. This front elastic seal 26 has an upper edge portion 26*a* integrally formed with the boundary elastic seal 24. As illustrated in FIG. 5(A) to FIG. 5(C), the front elastic seal 26 is in the shape of a horse's hoof. This front elastic seal 26 has a rear surface provided with a projection 64. This projection 64 is fitted into a hole provided in the front surface of the case lower portion 5*b*, thereby enabling the front elastic seal 26 to be detachably attached to the front surface of the case lower portion 5*b*.

In the case where the engine is housed in a bonnet of a weed mower or a lawn mower, there is provided a duct for introducing purified air from a filter into the bonnet. The case air-sucking port 25 is disposed opposite to an outlet of the duct for purified air. The duct outlet has an opening to a peripheral edge portion of which the front elastic seal 26 is tightly attached so as to be able to suck only the purified air from the purified-air duct.

The central cooling-air passage is devised as follows.

Figure 13:
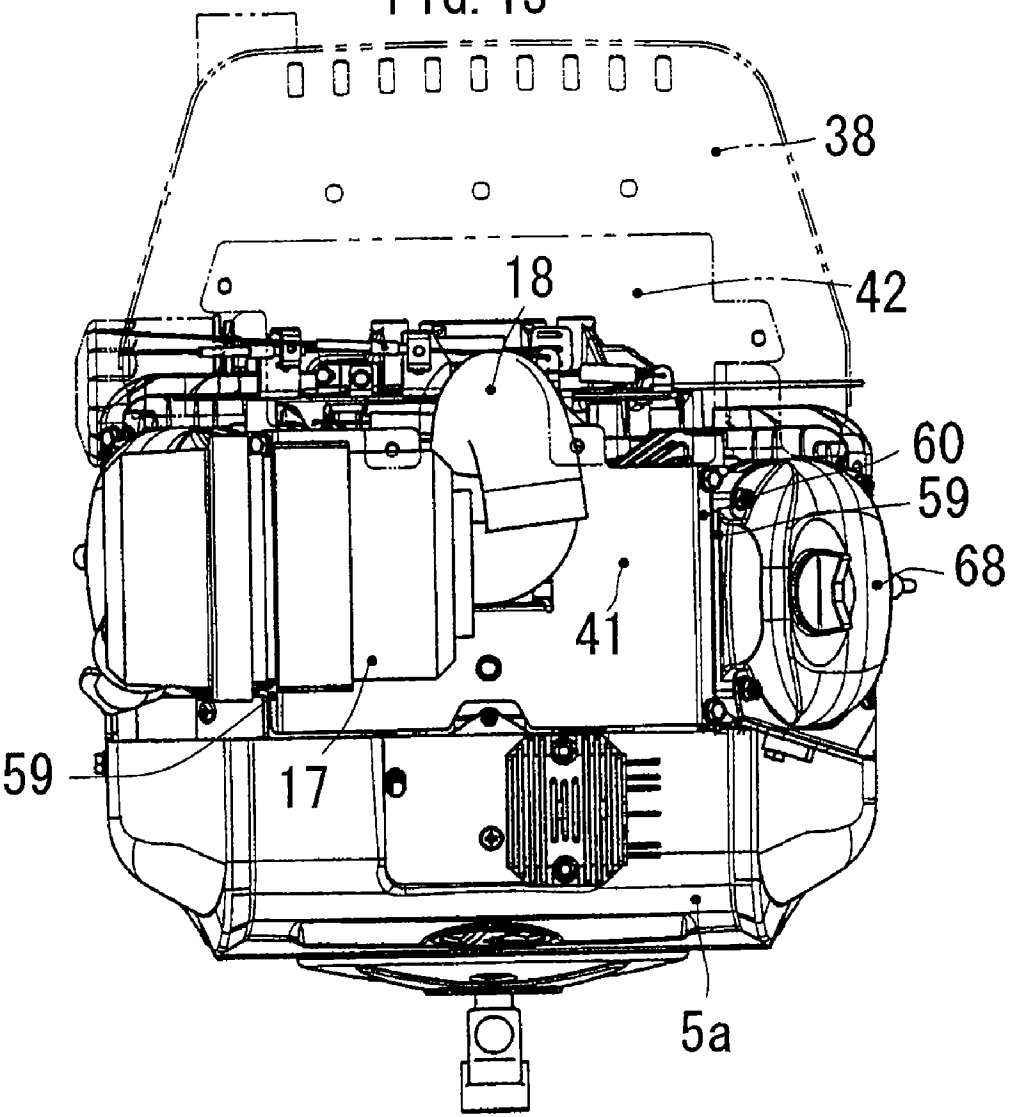
[FIG. 13] shows a top view of the engine shown in FIG. 1.

As shown in FIGS. 3 and 13, an air-passage ceiling plate 41 spans between the upper portions 59, 59 of the left and right cylinder heads 4, 4. This air-passage ceiling plate 41 covers the central cooling-air passage 8 from thereabove and has left and right side edge portions 60, 60 detachably attached to the upper portions 59, 59 of the cylinder heads 4, 4.

Further, the air-passage ceiling plate 41 has the left and right side edge portions 60, 60 made to extend along the upper portions 59, 59 of the left and right cylinder heads 4, 4.

The air-passage ceiling plate 41 is formed from a steel plate and has the left and right side edge portions 60, 60 tightly attached to upper peripheral edge portions of the cylinder heads 4, 4. The left and right side edge portions 60, 60 may be attached to the cylinder head covers 68, 68 attached to the cylinder heads 4, 4. Further, as for the material of the air-passage ceiling plate 41, from the view-point of radiating the heat of the cylinder heads 4, 4, it is advantageous to employ a metal or other like materials of a relatively high heat-conductivity. But from the aspect of avoiding the overheating of the air-passage ceiling plate 41, synthetic resin or other like material of a relatively low heat-conductivity may be used. Besides, from a view-point of radiating the heat of the cylinder heads 4, 4, although it is advantageous to tightly attach the air-passage ceiling plate 41 to the upper portions 59, 59 of the cylinder heads 4, 4, an insulator may be interposed between the upper portions 59, 59 of the cylinder heads 4, 4 to inhibit the heat conductivity to a certain degree from the aspect of avoiding the overheating of the air-passage ceiling plate 41.

Figures 6A, 6B, 6C:
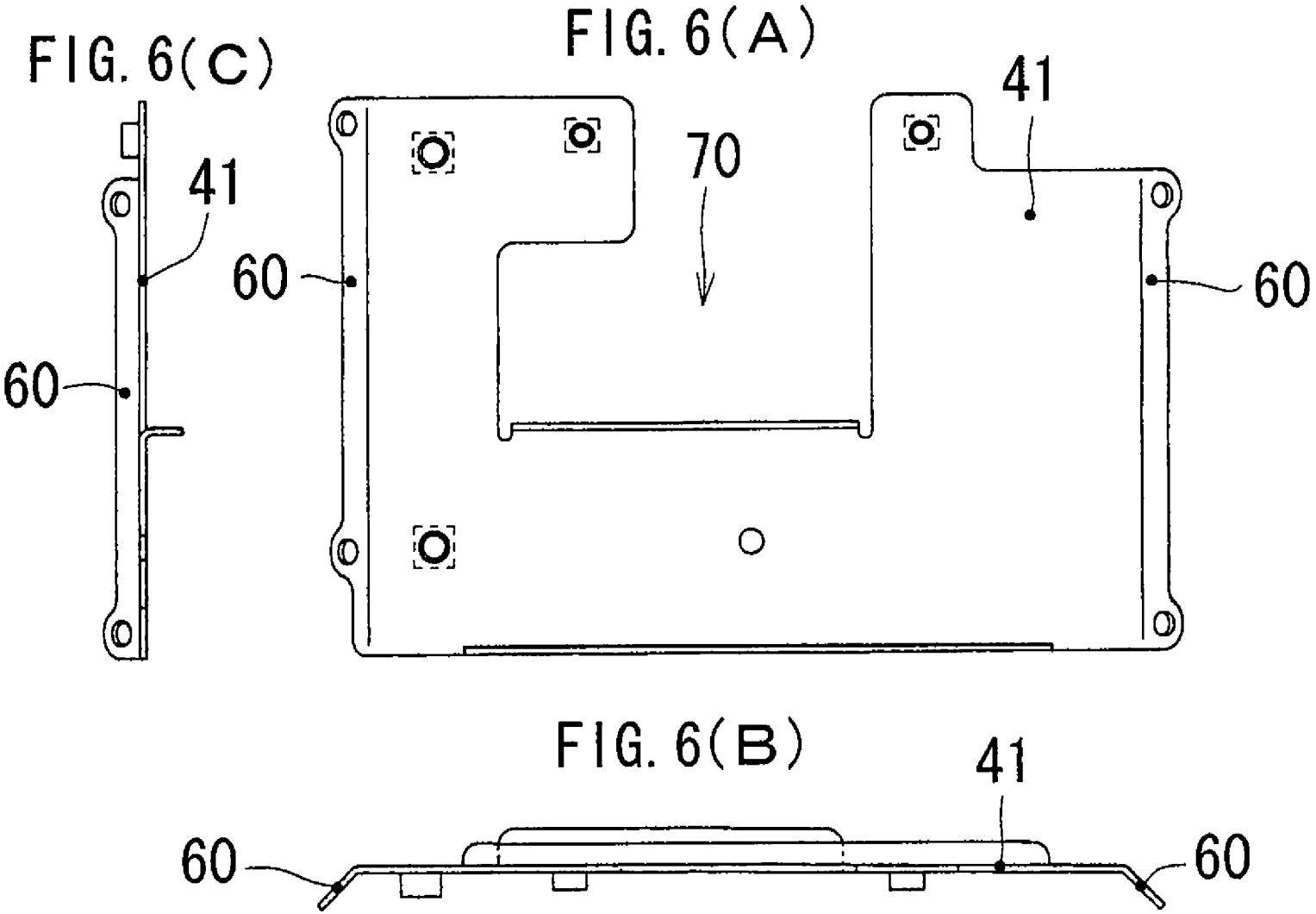
FIG. 6(A), FIG. 6(B) and FIG. 6(C) are a top view, a front view and a side view.

As depicted in FIG. 6(A) to FIG. 6(C), the air-passage ceiling plate 41 is formed from a flat plate by bending left and right side edge portions 60, 60 of the flat plate slantwise downwardly and has its rear-half portion formed with a rear L-shaped notch 70, which the intake-air hose 18 of the air cleaner 17 passes through and which the intake-air inlet 46 of the air cleaner 17 is arranged opposite to.

The exhaust muffler has the following cooling structure.

As shown in FIG. 2, the air-passage ceiling plate 41 has a rear end portion, below which there is formed an outlet 40 of the central cooling-air passage 8. An exhaust muffler 37 is arranged behind the central cooling-air passage 8 and is covered with a muffler cover 38. The muffler cover 38 has at its front portion a cooling-air inlet 39 opposite to the outlet 40 of the central cooling-air passage 8 so that the cooling air passed through the central cooling-air passage 8 is introduced into the muffler cover 38.

Figures 9A, 9B, 9C:
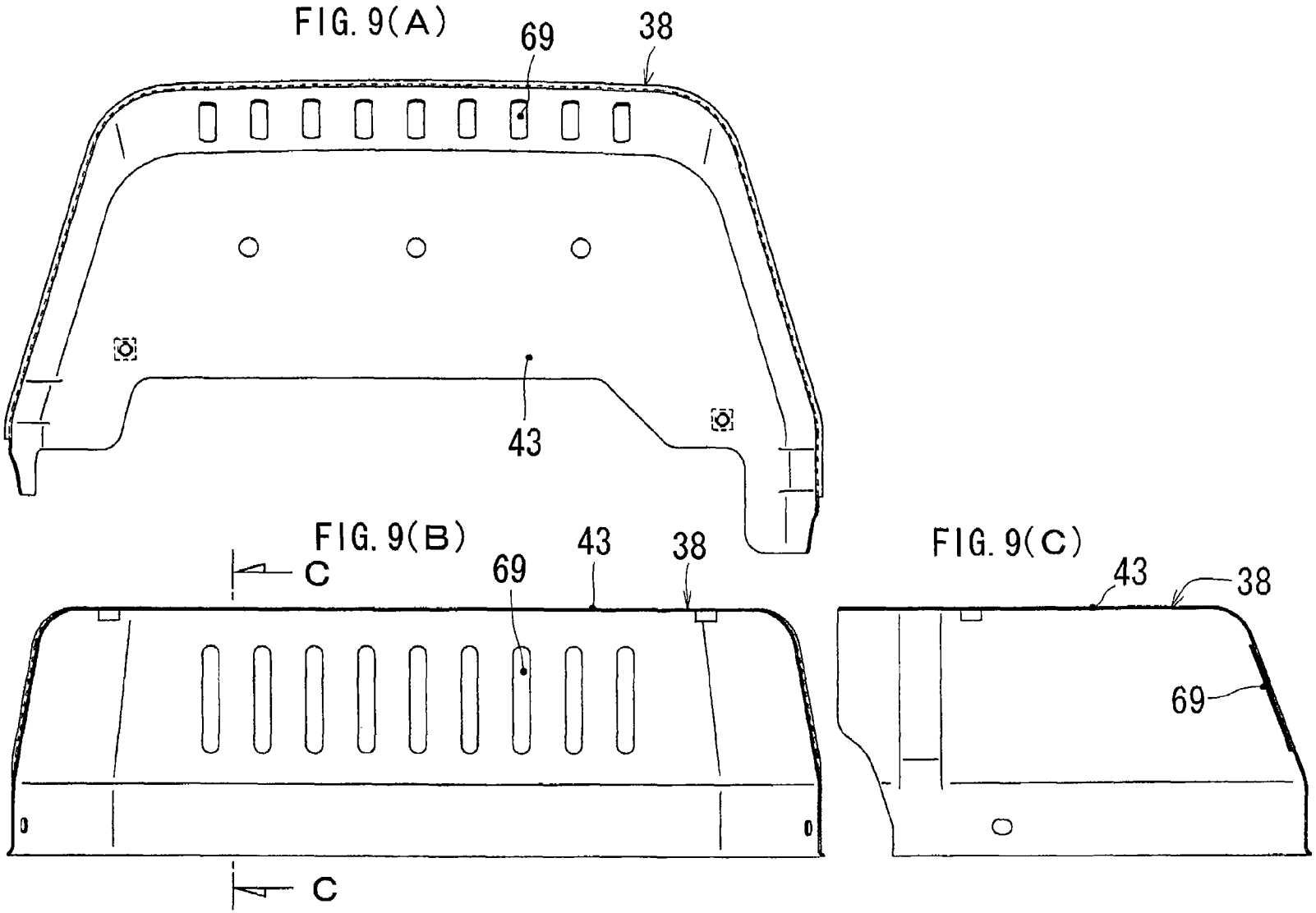
FIG. 9(A), FIG. 9(B) and FIG. 9(C) are a top view, a front view and a sectional view taken along a line C-C of FIG. 9(B)

As illustrated in FIG. 9(A) to FIG. 9(C), the muffler cover 38 is made of a steel plate and has a box-shaped structure with its front and bottom portions opened, the rear surface of which is formed with an air-release port 69.

As shown in FIG. 2, an extension plate 42 is conducted out of the air-passage ceiling plate 41 of the central cooling-air passage 8 rearwardly. This extension plate 42 covers a ceiling plate 43 of the muffler cover 38 from thereabove and holds an air-release gap 50 between itself and the muffler-cover ceiling plate 43. The cooling air 44, 45 released from the cooling-air outlet 40 of the central cooling-air passage 8 is made to flow along upper and lower surfaces of the ceiling plate 43 of the muffler cover 38. The cooling air that has passed through the air-release gap 50 is released along the upper surface of the muffler cover 43 rearwardly.

Figure 7A:
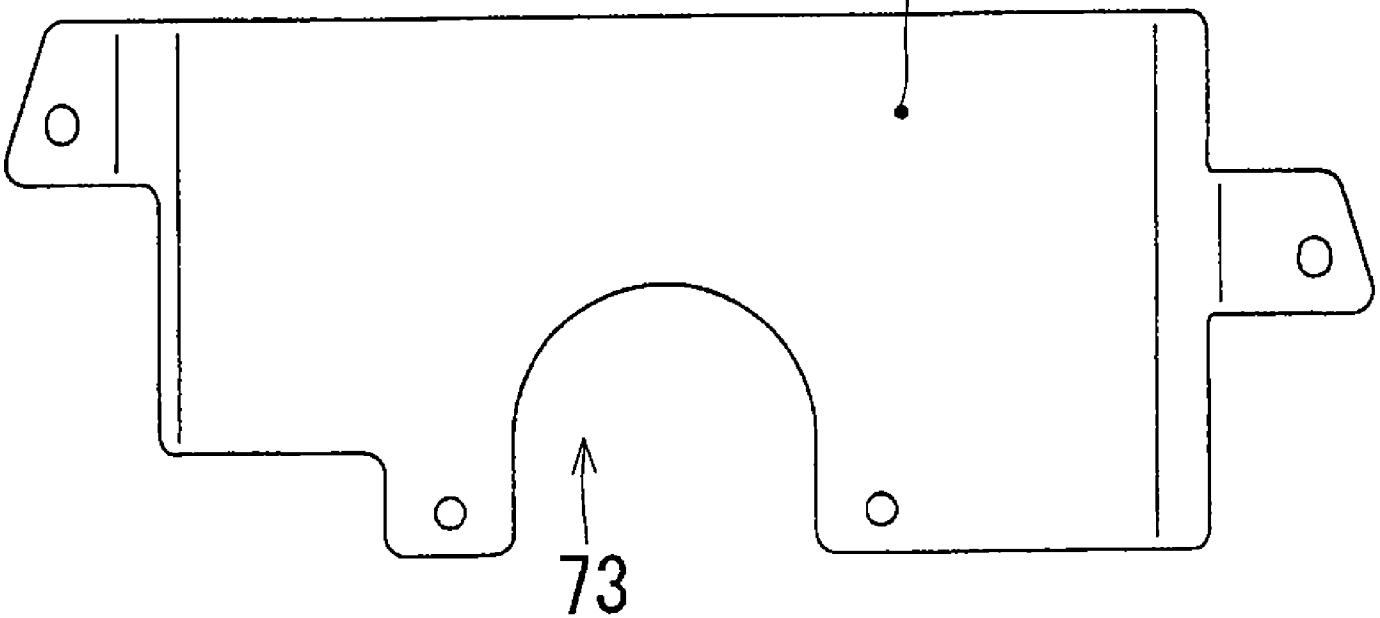
FIG. 7(A) and FIG. (B) are a top view and a plan view.
Figure 7B:
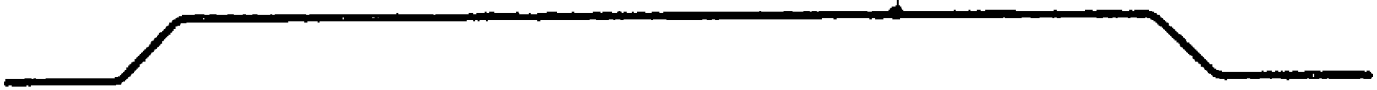
[FIG. 7] shows an extension plate to be used in the engine of FIG. 1.
Figure 8:
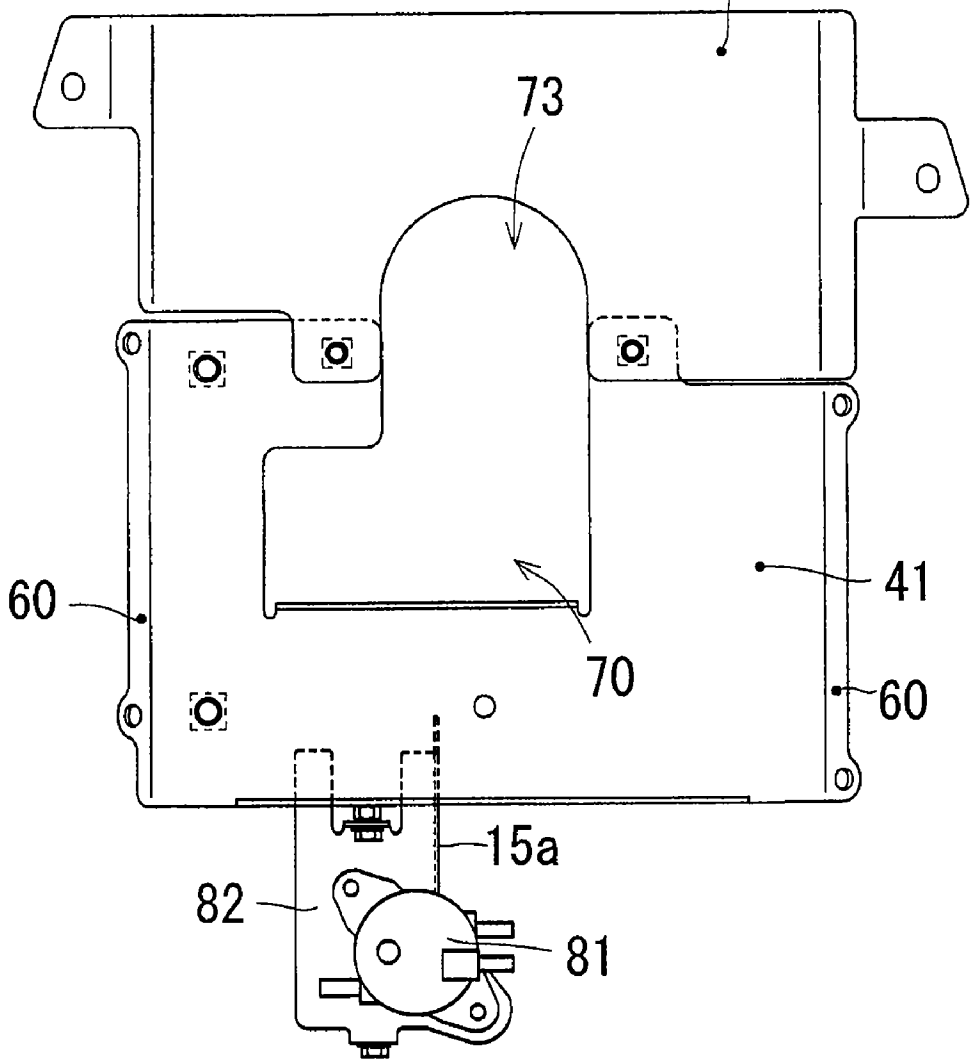
[FIG. 8] is a top view of the air-passage ceiling plate and extension plate combined together to be used in the engine of FIG. 1.

As depicted in FIG. 7, the extension plate 42 as well as the air-passage ceiling plate 41 is formed from a flat steel plate by bending both of its left and right side edge portions slantwise downwardly and has a front portion provided with a front notch 73. As shown in FIG. 8, this extension plate 42 is detachably attached to the rear portion of the air-passage ceiling plate 41 for use. As shown in FIG. 3, this ceiling plate 43 is detachably attached to the muffle-cover ceiling plate 43. The notch 73 provided at the front portion of the extension plate 42 is communicated with the rear notch 70 of the air-passage ceiling plate 41 so as to be communicated with the air-intake hose 18 of the air cleaner 17.

In view of radiating the heat of the exhaust muffler 37, a metal or other like material of a relative high heat-conductivity is preferably employed for the muffler cover 38 and the extension plate 42. But from the aspect of avoiding the overheating of the muffler cover 38 and the extension plate 42, synthetic resin or other like material of a relatively low heat-conductivity may be utilized.

A device is made to increase the air-intake efficiency as follows.

As shown in FIGS. 1 and 13, the air cleaner 17 is arranged to extend along the upper surface of the ceiling plate 41 of the central cooling-air passage 8. As shown in FIG. 4, the air cleaner 17 has the intake-air inlet 46 made opposite to the central cooling-air passage 8 and is detachably attached to the air-passage ceiling plate 41.

A device is made to cool the cylinder and the cylinder head or the like as follows.

Figure 14A:
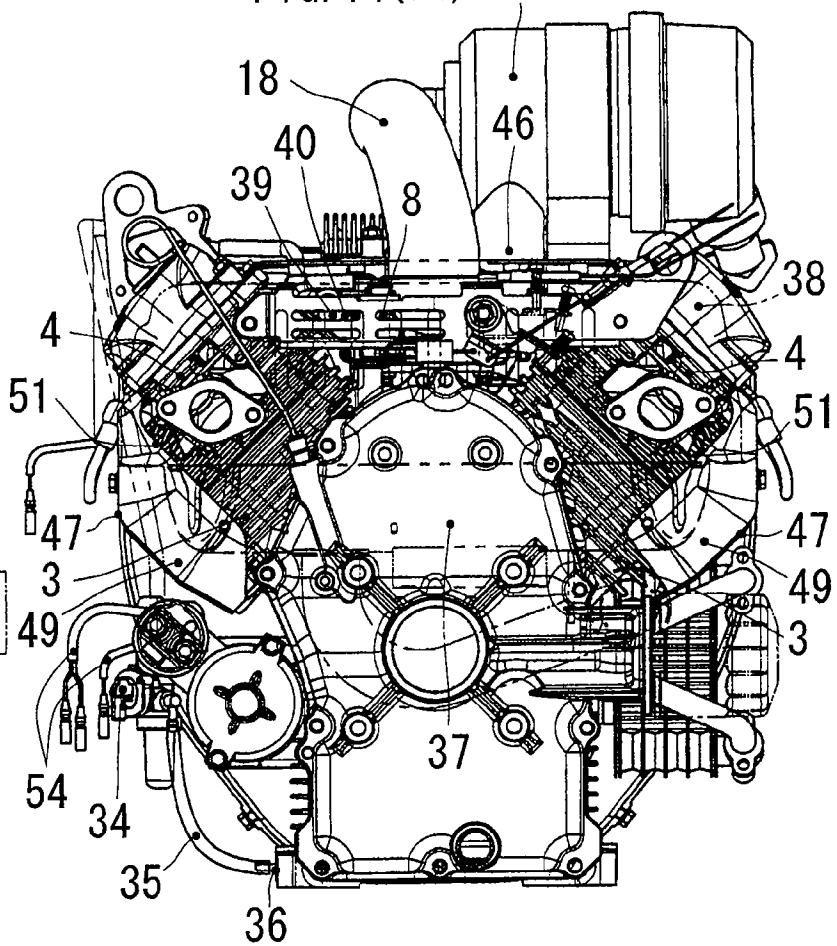
FIG. 14(A) is a rear view and FIG. 14(B) is a right side view.
Figure 14B:
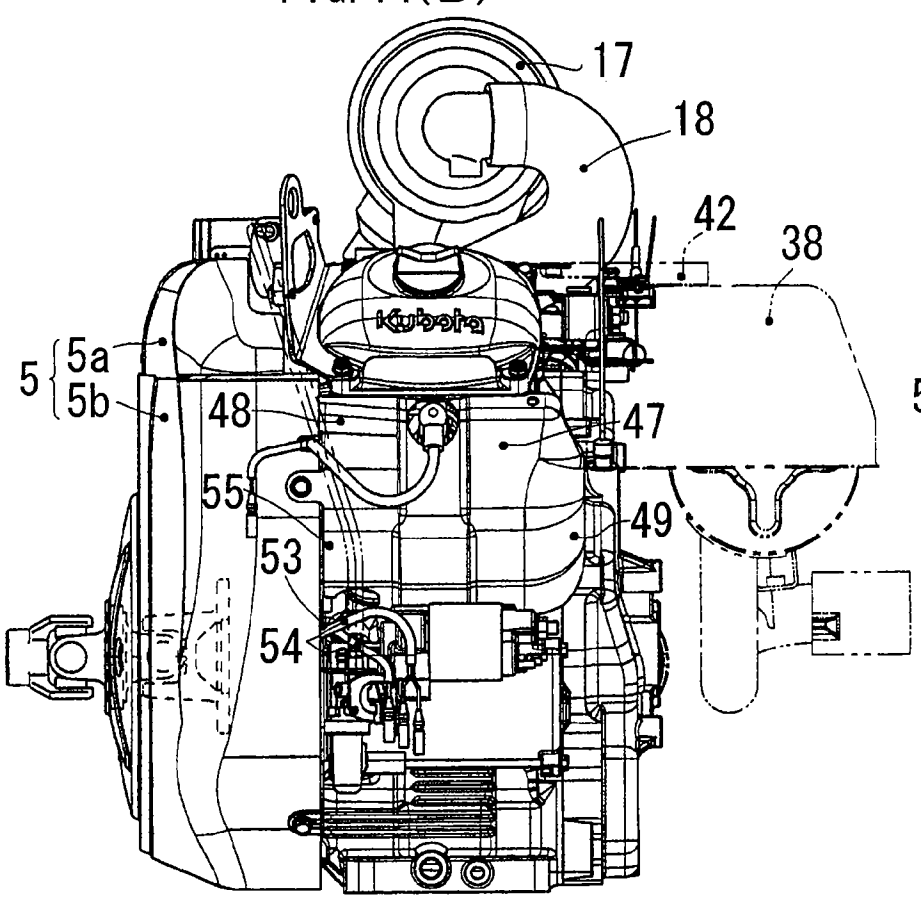

As shown in FIGS. 14(A) and 14(B), left and right lateral cooling-air passage palates 47, 47 are provided so as to extend along lateral peripheral side walls of the cylinder 3 and the cylinder head 4, on a side opposite to the central cooling-air passage while holding the left and right cylinders 3 and cylinder heads 4 therebetween. A lateral cooling-air passage is formed within each of the lateral cooling-air passage walls 47 and has a front end provided with a cooling-air inlet 48, which is communicated with the fan case 5.

As illustrated in FIGS. 14(A) and 14(B), left and right rear cooling-air passage plates 49, 49 are conducted out of the rear end portions of the left and right lateral cooling-air passage plates 47, 47 so as to extend along rear peripheral wall surfaces of the left and right cylinders 3 and cylinder heads 4 to form rear cooling-air passages plates 49, 49 within which there are formed rear cooling-air passages. Each of the rear cooling-air passages has a cooling-air outlet 51 oriented to the outlet 40 of the central cooling-air passage 8.

A support structure for electric cords is as follows.

Figures 10A, 10B:
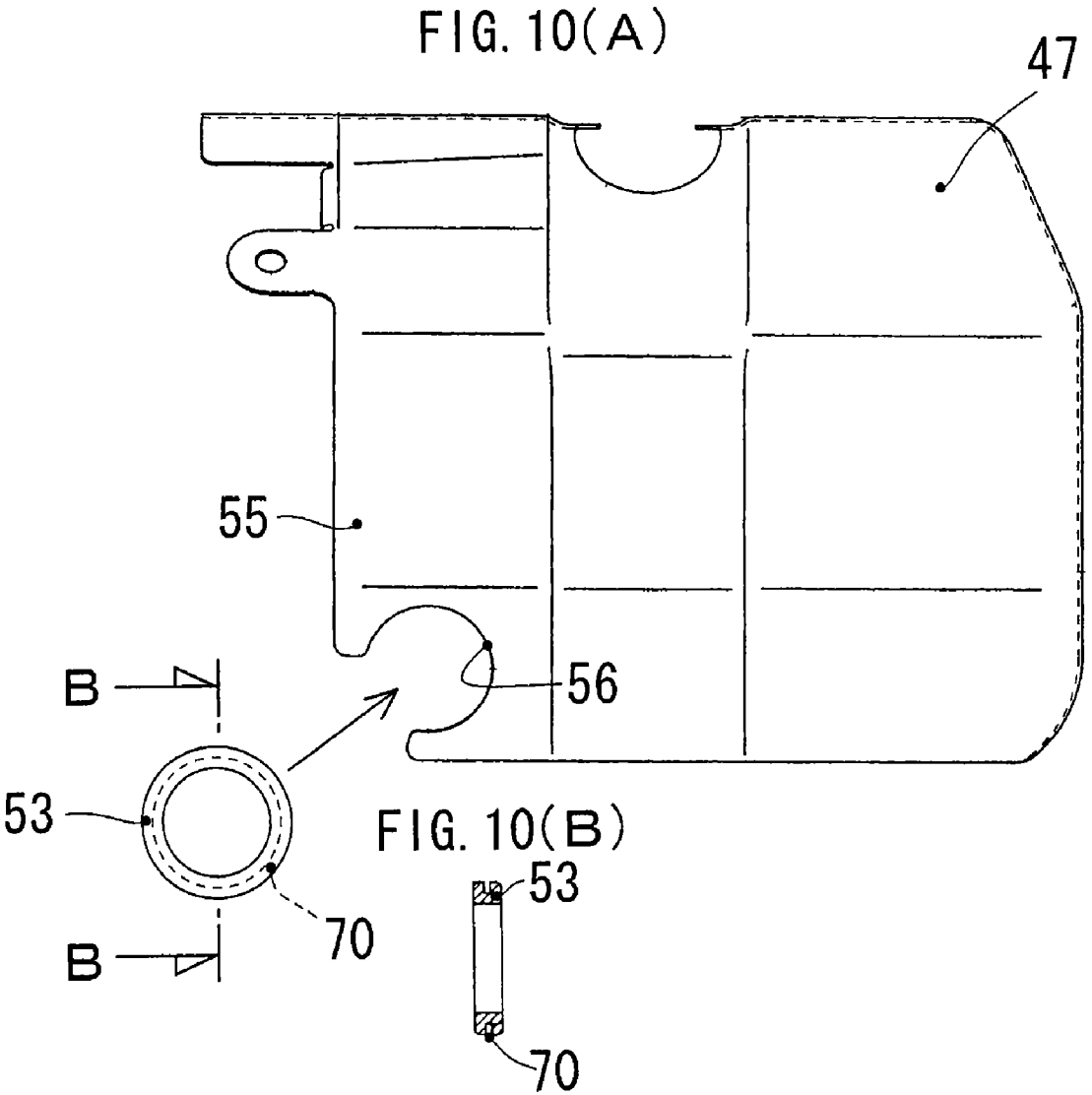
FIG. 10(A) is a side view of them and FIG. 10(B) is a sectional view taken along a line B-B in FIG. 10(A)

As shown in FIGS. 10(A) and 10(B), an annular grommet 53 is attached to at least one of the left and right cooling-air passage plates 47, 47. A plurality of electric cords 54 are inserted through the grommet 53 to support the latter.

The electric cord 54 is an electric cord such as a charging coil, an ignition coil, a fuel-cut solenoid for a carburetor or the like.

As depicted in FIGS. 10(A) and 14(B), the lateral cooling-air passage plate 47 is detachably attached to the engine main body and has a front end edge portion 55 provided with a notch 56. The grommet 53 is moved along the notch 56 radially thereof, thereby enabling the grommet 53 to be detachably attached to the notch 53 with the electric cords 54 as they are inserted therethrough.

The grommet is made of rubber and is formed in the shape of a circular ring and has its peripheral surface provided with a groove 70 as shown in FIG. 10(B). The grommet 53 can be attached to the notch 56 by fitting this groove 70 into the peripheral edge portion of the notch 56.

The following device is made for attaching the throttle body.

Figures 11A, 11B:
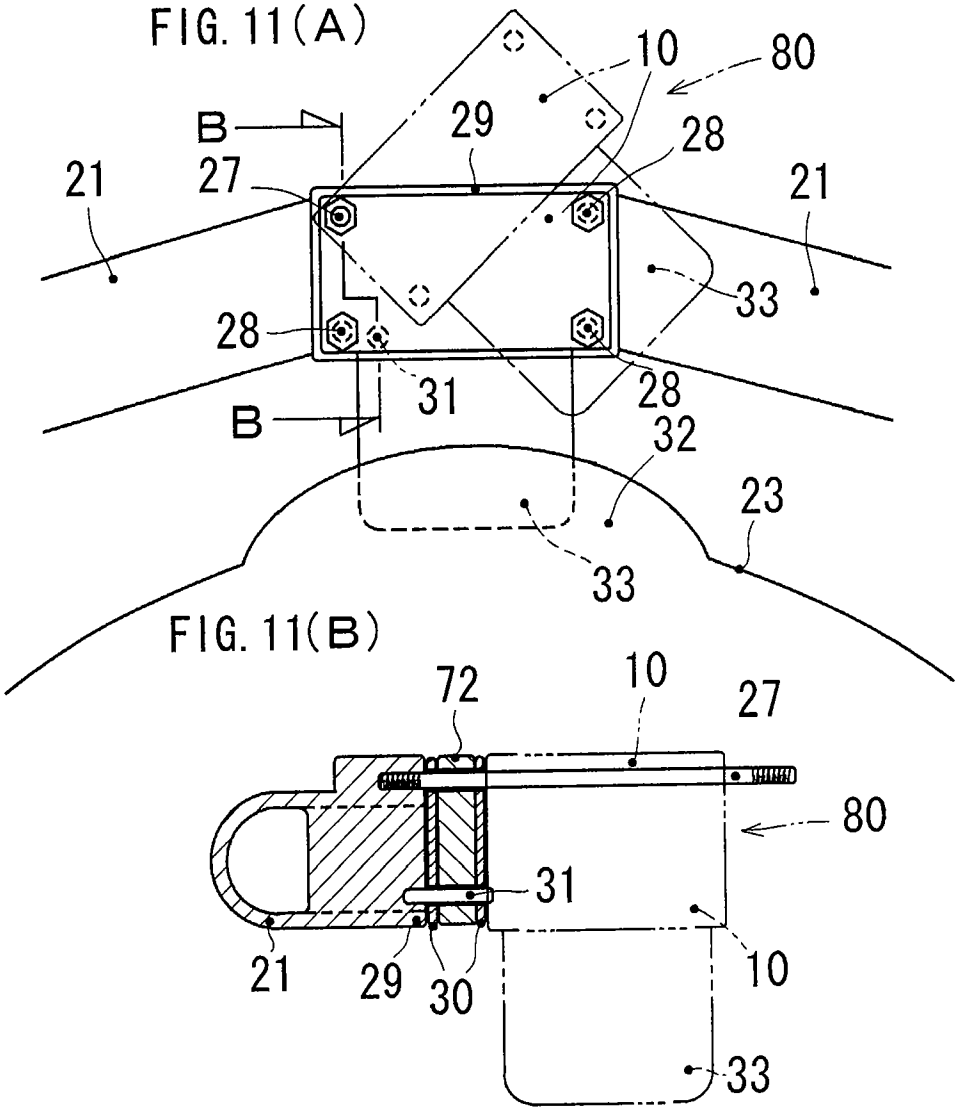
FIG. 11(A) is a rear view of the throttle body and its surrounding portions and FIG. 11(B) is a sectional view taken along a line B-B in FIG. 11.

As illustrated in FIG. 11(A), a plurality of screw fasteners attach to the inlet portions 29 of the left and right intake-air pipes 21, 21, the throttle body 10 from the rear thereof. One of the screw fasteners is a stud bolt 27 and the remaining others are headed bolts 28.

As depicted in FIGS. 11(A) and 11(B), gaskets 30, are interposed between the inlet portions 29 of the left and right intake-air pipes 21, 21 and the throttle body 10. In order to fasten the gaskets 30, 30 to the inlets portions 29 of the left and right intake-air pipes 21, 21 together with the throttle body 10 through these screw fasteners, the following arrangement is made.

More specifically, gasket-support pins 31 project from the inlet portions 29 of the left and right intake-air pipes 21, 21 and are inserted through the gaskets 30, 30. Therefore, even if the headed bolts 28 are extracted out of the gaskets 30, 30, the gaskets 30, 30 with the stud bolts 27 inserted therethrough are arranged to stop their rotation by the gasket-support pins 31.

An insulator 72 is interposed between the inlet portions of the left and right intake-air pipes 21, 21 and the throttle body 10 as well as the gaskets 30, 30. The gasket-support pins 31, 31 are also inserted through the insulator 72. Accordingly, even if the headed bolts 28 are taken out of the insulator 72, the insulator 72 with the stud bolt 27 inserted therethrough is arranged to stop its rotation by the gasket-support pins 31.

Further, the intake-air joint pipe 19 is also fastened together with the throttle body 10 by the screw fasteners but for convenience, it is not shown in FIG. 11(A).

As shown in FIG. 2, the central cooling-air passage 8 has a rear portion provided with a projection 32 which houses an upper portion of a timing transmission device 58. This projection 32 is protruded upwardly from the ceiling wall 23 of the crank case 2. A liquid-fuel chamber 33 is attached in front of this projection 32 below the throttle body 10 and then is moved vertically downwardly to a position lower than the uppermost portion of the projection 32. For this purpose, the following arrangement is made.

More specifically, as shown in FIG. 11(A), the stud bolt 27 is arranged at a position higher than the uppermost portion of the projection 32 and the throttle body 10 is rotated around the stud bolt 27, thereby allowing the liquid-fuel chamber 33 to come to a position where it does not interfere with the projection 32. Thus the throttle body 10 can be extracted out rearwardly from the stud bolt 27.

The timing transmission device 58 is a timing gear train which transmits power from the crank shaft 6 to a valve-operation cam shaft 74.

A fuel drain is devised as follows.

As shown in FIG. 4 and FIG. 14(A), the liquid-fuel chamber 33 is arranged at a lower portion of the throttle body 10. In order to interlockingly connect this liquid-fuel chamber 33 to a fuel cock 34 and lead a flexible fuel-drain tube 35 out of the fuel cock 34, the following arrangement is made.

More specifically, as shown in FIG. 14(A), a pin 36 for supporting a terminal end of the tube 35 is attached to an engine's wall. The fuel-drain tube 35 has a terminal end portion fitted into this tube terminal-end support pin 36 removably so as to close the terminal end portion of the fuel-drain tube 35 by the tube terminal-end support pin 36.

The fuel cock 34 can be switched over to the alternative of a fuel-supply operation position able to supply the fuel from a fuel reservoir to the liquid-fuel chamber 33, a fuel-supply stop position for stopping the fuel supply and a fuel-drain operation position for taking out the fuel from the liquid-fuel chamber 33.

The following device concerns the fuel supply pump.

As shown in FIG. 1, there is arranged within the fan case 5 a fuel-supply pump 81 for supplying the fuel to the throttle body 10.

The fan case 5 is formed into a structure divisible into an upper and a lower portions. The case upper portion 5*a* is removable while leaving the case lower portion 5*b* in the engine main body. The fuel-supply pump 81 is attached to the engine main body, thereby enabling the case upper portion 5*a* to be removable without taking out the fuel-supply pump 81. The fuel-supply pump 81 is attached to the engine main body through an attaching plate 82. The fuel-supply pump 81 is actuated by the pulsation pressure of a crank chamber to supply gasoline from the fuel reservoir (not shown) to the liquid-fuel chamber 33 for the carburetor 80. This fuel-supply pump 81 may be another pump which supplies fuel under pressure to an injector (not shown) attached to the throttle body 10.

Instead of attaching the fuel-supply pump 81 to the engine main body, the fuel-supply pump may 81 may be attached to the case lower portion 5*b*.

The attaching plate 82 is arranged at a position against which the divided flows of the cooling air blow. The fuel-supply pump 81 is attached to this attaching plate 82. This attaching plate 82 is disposed toward one of the cylinder heads 4 ahead of the central cooling-air passage 8 and is supported by the intake-air pipe 21 and the air-passage ceiling plate 41.

The flow-dividing plate 9 is composed of the bottom-plate 14 and the left and right side-plate portions 15, 15. The left and right side-plate portions 15, 15 are arranged above the opposite end portions of the bottom-plate portion 14. One of the side-plate upper portions 15*a*, 15*a* of the left and right side-plate portions 15, 15 is conducted out of the attaching plate 82 of the fuel-supply pump 81.

The attaching plate 82 covers the fuel-supply pump 81 from therebelow.

What is claimed is:

1. An air-cooled V-shaped engine comprising an engine main body formed by projecting cylinders (3) from a crank case (2) obliquely upwardly in a left and right direction when seen from the front in a direction parallel to a crank-shaft center axis (1) and attaching a cylinder head (4) to a projecting end of each of the cylinders (3), a fan case (5) being attached to a forward portion of the engine main body, an air-blowing fan (7) being housed in the fan case (5), a central cooling-air passage (8) being formed between the left and right cylinders (3), (3) and between the cylinder heads (4), (4), cooling air produced by the air-blowing fan (7) being supplied to the central cooling-air passage (8), a throttle body (10) and a flow-dividing plate (9) being arranged in front of the central cooling-air passage (8), the flow-dividing plate (9) being provided in the fan case (5) at a position forwardly of the throttle body (10), the flow-dividing plate (9) having a bottom-plate portion (14) arranged at a position lower than the throttle body (10), the cooling air generated by the air-blowing fan (7) being divided into left and right side portions of the central cooling-air passage (8), wherein the fan case (5) has a ceiling wall a mid portion (11) of which is arranged just above the bottom-plate portion (14) of the flow-dividing plate (9), the ceiling-wall mid portion (11) of the flow-divided plate (9) being provided at a position higher than the throttle body (10) as well as mid side portions (12), (12) of the ceiling wall, conducted out of the mid portion (11) in the left and right direction.

2. The air-cooled V-shaped engine as set forth in claim 1, wherein the flow-dividing plate (9) comprises the bottom-plate portion (14) and left and right side-plate portions (15), (15), the left and right side-plate portions (15), (15) being arranged above the opposite end portions of the bottom-plate portion (14), and the bottom-plate portion (14) of the flow-dividing plate (9) is led out rearwardly, the thus led-out bottom-plate portion (14) covering the throttle body (10) from therebelow, the left and right side-plate portions (15), (15) being conducted out rearwardly, the thus conducted-out side-plate portions (15), (15) covering the throttle body (10) from the left and right opposite sides of the latter.

3. The air-cooled V-shaped engine as set forth in claim 2, wherein an intake-air hose (18) is led out of an air cleaner (17) and an intake-air joint pipe (19) is attached between the left and right cylinder heads (4), (4) so as to connect the intake-air hose (18) to a rear portion of the throttle body (10), the intake-air joint pipe (19) having a lower portion to which a heat-insulating plate (20) is attached, this heat-insulating plate (20) being conducted out forwardly to cover the throttle body (10) from therebelow.

4. The air-cooled V-shaped engine as set forth in claim 1, wherein the fan case (5) is formed into a structure divisible into an upper and a lower portions, the case upper portion (5*a*) being removable while leaving the case lower portion (5*b*) in the engine main body.

5. The air-cooled V-shaped engine as set forth in claim 4, wherein in order to make left and right intake-air pipes (21), (21) span laterally between a front surface of the throttle body (10) and front surfaces of the left and right cylinder heads (4), (4), when seen from the front in the direction parallel to the crank-shaft center axis (1), the case (5) is divided so that a boundary (5*c*) between the case upper and lower portions (5*a*), (5*b*) crosses a front portion of the left and right intake-air pipes (21), (21) laterally.

6. The air-cooled V-shaped engine as set forth in claim 5, wherein the flow-dividing plate (9) comprises the bottom-plate portion (14) and left and right side-plate portions (15), (15), in order to insert the left and right intake-air pipes (21), (21) into the left and right side-plate portions (15), (15), the left and right side-plate portions (15), (15) are also divided so that the side-plate upper portions (15*a*), (15*a*) are provided in the case upper portion (5*a*) and the side-plate lower portions (15*b*), (15*b*) are disposed within the case lower portion (5*b*), and at least one of the side-plate upper portions (15*a*), (15*a*) and the side-plate lower portions (15*b*), (15*b*) are provided with left and right fitting concaved portions (16, (16), into which the respective intake-air pipes (21), (21) are fitted, each of the intake-air pipes (21), (21) being provided with a flange (22) which covers a fitting gap (16*a*) between every fitting concaved portion (16) and every intake-air pipe (21) from its lateral side.

7. The air-cooled V-shaped engine as set forth in claim 4, wherein the case lower portion (5*b*) is fixed to the crank case (2) and the case upper portion (5*a*) is fixed to the cylinder head (4), and a boundary elastic seal (24) is held to a space of a boundary (5*c*) between the case lower portion (5*b*) and the case upper portion (5*a*).

8. The air-cooled V-shaped engine as set forth in claim 7, wherein a front-surface elastic seal (26) surrounding a case air-sucking port (25) is attached to a front surface of the case lower portion (5*b*) and has an upper edge portion (26*a*) integrally formed with the boundary elastic seal (24).

9. The air-cooled V-shaped engine as set forth in claim 1, wherein an air-passage ceiling plate (41) is made to span between upper portions (59), (59) of the left and right cylinder heads (4), (4) and covers the central cooling-air passage (8) from thereabove, the air-passage ceiling plate (41) having left and right side edge portions (60), (60) detachably attached to the upper portions (59), (59) of the cylinder heads (4), (4).

10. The air-cooled V-shaped engine as set forth in claim 9, wherein the air-passage ceiling plate (41) has the left and right side edge portions (60), (60) made to extend along the upper portions (59), (59) of the left and right cylinder heads (4), (4).

11. The air-cooled V-shaped engine as set forth in claim 9, wherein the air-passage ceiling plate (41) has a rear end portion, below which a cooling-air outlet (40) of the central cooling-air passage (8) is formed, and an exhaust muffler (37) is arranged behind the central cooling-air passage (8) and is covered with a muffler cover (38), the muffler cover (38) having at its front portion a cooling-air inlet (39) positioned opposite to the cooling-air outlet (40) of the central cooling-air passage (8), the cooling air that has passed through the central cooling-air passage (8) being introduced into the muffler cover (38).

12. The air-cooled V-shaped engine as set forth in claim 11, wherein an extension plate (42) is conducted out of the air-passage ceiling plate 41 of the central cooling-air passage (8) rearwardly, and the thus conducted-out extension plate (42) covers the ceiling plate (43) of the muffler cover (38) from thereabove, an air-release gap (50) being held between the extension plate (42) and the muffler-cover ceiling plate (43), the cooling air (44), (45) to be released from the cooling-air outlet (40) of the central cooling-air passage (8) being made to flow along upper and lower surfaces of the ceiling plate (43) of the muffler cover (38), the cooling air (44) that has passed through the air-release gap (50) being arranged to be released along the upper surface of the muffler cover (43) rearwardly.

13. The air-cooled V-shaped engine as set forth in claim 12, wherein an air cleaner (17) is arranged along the upper surface of the air-passage ceiling plate (41) of the central cooling-air passage (8).

14. The air-cooled V-shaped engine as set forth in claim 9, wherein the air cleaner (17) has its air intake-inlet (46) positioned opposite to the central cooling-air passage (8).

15. The air-cooled V-shaped engine as set forth in claim 1, wherein left and right lateral cooling-air passage plates (47), (47) are provided along lateral peripheral side walls of the cylinder (3) and the cylinder head (4), on a side opposite to the central cooling-air passage (8), while holding the left and right cylinders (3) and cylinder heads (4) therebetween, a lateral cooling-air passage being formed within each of the lateral cooling-air passage plates (47), the lateral cooling-air passage having a front end provided with a cooling-air inlet (48), which is communicated with the fan case (5).

16. The air-cooled V-shaped engine as set forth in claim 15, wherein an exhaust muffler (37) is arranged behind the central cooling-air passage (8) and is covered with a muffler cover (38), in order to position a cooling-air inlet (39) at a front portion of the muffler cover (38) opposite to a cooling-air outlet (40) of the central cooling-air passage (8), left and right rear cooling-air passage plates (49), (49) are conducted out of rear end portions of the left and right lateral cooling-air passage plates (47), (47) so as to extend along rear peripheral wall surfaces of the left and right cylinders (3) and cylinder heads (4), a rear cooling-air passage being formed within each of the rear cooling-air passage plates (49), each of the rear cooling-air passages having a cooling-air outlet (51) oriented to the cooling-air outlet (40) of the central cooling-air passage (8).

17. The air-cooled V-shaped engine as set forth in claim 15, wherein an annular grommet (53) is attached to at least one of the left and right lateral cooling-air passage plates (47), (47) and a plurality of electric cords (54) are inserted through this grommet (53) for supporting the latter.

18. The air-cooled V-shaped engine as set forth in claim 17, wherein the grommet (53) is disposed at a front end edge portion of the lateral cooling-air passage plate (47) which is arranged opposite to an interior area of the fan case (5).

19. The air-cooled V-shaped engine as set forth in claim 18, wherein the lateral cooling-air passage plate (47) is detachably attached to the engine main body, and has a front end edge portion (55) provided with a notch (56), along which the grommet (53) is moved radially of the notch (56) so that the grommet (53) is attached and detached to the notch (56) with the electric cords (54) inserted through the grommet (53).

20. The air-cooled V-shaped engine as set forth in claim 1, wherein a plurality of screw fasteners attach the throttle body (10) to the inlet portions (29) of the left and right intake-air pipes (21), (21) from the rear portion of the throttle body (10), the screw fasteners comprising a stud bolt (27) and headed bolts (28) as the remaining ones.

21. The air-cooled V-shaped engine as set forth in claim 20, wherein gaskets (30), (30) are interposed between the inlet portions (29) of the left and right intake-air pipes (21), (21) and the throttle body (10), the plurality of screw fasteners extending through the gaskets (30), (30), in order to fasten the gaskets (30), (30) to the inlet portions (29) of the left and right intake-air pipes (21), (21) together with the throttle body (10) by the screw fasteners, gasket-support pins (31) project from the inlet portions (29) of the left and right intake-air pipes (21), (21) and are inserted through the gaskets (30), (30), and even if the headed bolts (28) are extracted out of the gaskets (30), (30), the gasket-support pints (31), (31) stops the rotation of the gaskets (30), (30) with the stud bolts (27) inserted therethrough.

22. The air-cooled V-shaped engine as set forth in claim 20, wherein the central cooling-air passage (8) has a rear portion provided with a projection (32) which houses an upper portion of a timing transmission device (58), the projection (32) being protruded upwards from a ceiling wall (23) of the crank case (2), a liquid-fuel chamber (33) being attached to a lower portion of the throttle body (10) ahead of the projection (32), in order to vertically downwardly provide the liquid-fuel chamber (33) to a position lower than the uppermost portion of the projection (32), the stud bolt (27) is arranged at a position higher than the uppermost portion of the projection (32), and the liquid-fuel chamber (33) is positioned so that it does not interfere with the projection (32) by rotating the throttle body (10) around the stud bolt (27), the throttle body (10) being made extractable from the stud bolt (27) rearwardly.

23. The air-cooled V-shaped engine as set forth in claim 1, wherein the throttle body (10) is provided with a liquid-fuel chamber (33), the liquid-fuel chamber (33) and a fuel cock (34) being interlockingly connected to each other, in order to lead a flexible fuel-drain tube (35) out of the fuel cock (34), a pin (36) for supporting a terminal end of the tube (35) is attached to the engine's wall, the fuel-drain tube (35) having a terminal end which is removably fitted into the tube terminal-end support pin (36), thereby enabling the support pin (36) to close the terminal end portion of the fuel-drain tube (35).

24. The air-cooled V-shaped engine as set forth in claim 1, wherein there is arranged within the fan case (5) a fuel-supply pump (81) which supplies fuel to a side of the throttle body (10).

25. The air-cooled V-shaped engine as set forth in claim 24, wherein the fan case (5) is formed into a structure divisible into an upper and a lower portions, so that the case upper portion (5*a*) is removable while leaving the case lower portion (5*b*) in the engine main body, and the fuel-supply pump (81) is attached to the engine main body, thereby allowing the case upper portion (5*a*) to be removed without taking out the fuel-supply pump (81).

26. The air-cooled V-shaped engine as set forth in claim 24, wherein the fan case (5) is formed into a structure divisible into an upper and a lower portions, so that the case upper portion (5*a*) is removable while leaving the case lower portion (5*b*) in the engine main body, and the fuel-supply pump (81) is attached to the case lower portion (5*b*), thereby allowing the case upper portion (5*a*) to be removed without taking out the fuel-supply pump (81).

27. The air-cooled V-shaped engine as set forth in claim 24, wherein an attaching plate (82) is arranged at a position against which divided flows of the cooling air blow and the fuel-supply pump (81) is attached to this attaching plate (82).

28. The air-cooled V-shaped engine as set forth in claim 27, wherein the flow-dividing plate (9) comprises the bottom-plate portion (14) and the left and right side-plate portions (15), (15), the left and right side-plate portions (15), (15) being arranged above the opposite end portions of the bottom-plate portion (14), one of the side-plate upper portions (15*a*), (15*a*) of the left and right side-plate portions (15), (15) is conducted out of the attaching plate (82) of the fuel-supply pump (81).

29. The air-cooled V-shaped engine as set forth in claim 27, wherein the attaching plate (82) covers the fuel-supply pump (81) from therebelow.

* * * * *